US007315289B2

(12) United States Patent
Puente Baliarda et al.

(10) Patent No.: US 7,315,289 B2
(45) Date of Patent: Jan. 1, 2008

(54) COUPLED MULTIBAND ANTENNAS

(75) Inventors: Carles Puente Baliarda, Sant Cugat del Valles Barcelona (ES); Jaume Anguera Pros, Vinaros (ES); Jordi Soler Castany, Mataro (ES); Antonio Condes Martínez, Esplugues de Llobregat (ES)

(73) Assignee: Fractus, S.A., Barcelona (ES)

( * ) Notice: Subject to any disclaimer, the term of this patent is extended or adjusted under 35 U.S.C. 154(b) by 29 days.

(21) Appl. No.: 11/075,980

(22) Filed: Mar. 9, 2005

(65) Prior Publication Data

US 2005/0195124 A1 Sep. 8, 2005

Related U.S. Application Data

(63) Continuation of application No. PCT/EP02/11355, filed on Sep. 10, 2002.

(51) Int. Cl.

| | |
|---|---|
| ***H01Q 21/00*** | (2006.01) |
| ***H01Q 1/48*** | (2006.01) |
| ***H01Q 1/36*** | (2006.01) |
| *H01Q 1/32* | (2006.01) |

(52) U.S. Cl. ..... 343/817; 343/846; 343/895

(58) Field of Classification Search ..... 343/700 MS, 343/702, 711, 795, 814–817, 846, 895
See application file for complete search history.

(56) References Cited

U.S. PATENT DOCUMENTS 4,628,322 A 12/1986 Marko et al.

(Continued)

FOREIGN PATENT DOCUMENTS

EP 0 942 488 9/1999

(Continued)

OTHER PUBLICATIONS

Hisamatsu Nakano et al., "Realization of Dual-Frequency and Wide-Band VSWR Performances Using Normal-Mode Helical and Inverted-F Antennas", IEEE Transactions on Antennas and Propagation, vol. 46, No. 6, Jun. 1998, pp. 788-793.

(Continued)

*Primary Examiner*—Shih-Chao Chen
(74) *Attorney, Agent, or Firm*—Winstead PC

(57) ABSTRACT

The present invention consists of an antenna comprising at least two radiating structures, said radiating structures taking the form of two arms, said arms being made of or limited by a conductor, superconductor or semiconductor material, said two arms being coupled to each other through a region on first and second superconducting arms such that the combined structure of the coupled two-arms forms a small antenna with a broadband behavior, a multiband behavior or a combination of both effects. According to the present invention, the coupling between the two radiating arms is obtained by means of the shape and spatial arrangement of said two arms, in which at least one portion on each arm is placed in close proximity to each other (for instance, at a distance smaller than a tenth of the longest free-space operating wavelength) to allow electromagnetic fields in one arm being transferred to the other through said specific close proximity regions. Said proximity regions are located at a distance from the feeding port of the antenna (for instance a distance larger than 1/40 of the free-space longest operating wavelength) and specifically exclude said feeding port of the antenna.

52 Claims, 17 Drawing Sheets

U.S. PATENT DOCUMENTS

| | | | | |
|---|---|---|---|---|
| 4,907,006 | A | 3/1990 | Nishikawa | |
| 5,365,246 | A | 11/1994 | Rasinger et al. | |
| 5,838,285 | A | 11/1998 | Tay | |
| 5,903,239 | A | 5/1999 | Takahashi | |
| 5,966,097 | A * | 10/1999 | Fukasawa et al. | 343/700 MS |
| 5,990,838 | A | 11/1999 | Burns et al. | |
| 6,337,667 | B1 * | 1/2002 | Ayala et al. | 343/795 |
| 6,373,447 | B1 | 4/2002 | Rostoker | |
| 6,466,176 | B1 | 10/2002 | Maoz et al. | |
| 6,509,882 | B2 * | 1/2003 | McKivergan | 343/818 |
| 2002/0075187 | A1 | 6/2002 | McKivergan | |
| 2004/0212545 | A1 | 10/2004 | Li | |

FOREIGN PATENT DOCUMENTS

| | | | |
|---|---|---|---|
| EP | 1195847 | A2 | 4/2002 |
| GB | 2387486 | A | 10/2003 |
| JP | 56-12102 | | 2/1981 |
| JP | 56012102 | | 2/1981 |
| JP | 5275918 | | 10/1993 |
| JP | 200250924 | | 2/2002 |
| JP | 2002141726 | A | 5/2002 |
| WO | WO-96/38881 | | 12/1996 |
| WO | 9950929 | A1 | 10/1999 |
| WO | WO-01/22528 | | 3/2001 |
| WO | 0131747 | A1 | 5/2001 |
| WO | WO-01-54225 | | 7/2001 |
| WO | WO-01/78192 | | 10/2001 |
| WO | 03047025 | A1 | 6/2003 |

OTHER PUBLICATIONS

Constantine A. Balanis, "Antenna Theory: Analysis and Design", Hamilton Printing, 1982 & 1997, pp. 498-502.

C. Puente et al., "Multiband Properties of a Fractal Tree Antenna Generated by Electrochemical Deposition", Electronics Letters, Dec. 5, 1996, vol. 32, No. 25, pp. 2298-2299.

Jaume Anguera et al., "Miniature WideBand Stacked Microstrip Patch Antenna Based on the Sierpinski Fractal Geometry", IEEE, 2000, pp. 1700-1703.

Chow et al., A dual-frequency-mode monopole-helical antenna with a parasitic normal-mode helix, Microwave and optical Technology Letters, Feb. 2001.

Pan et al. N anetnnas and their applications in portable handsets, IEEE Transactions on Antennas and Propagation, 1997, vol. 45, No. 10.

* cited by examiner

COUPLED MULTIBAND ANTENNAS

RELATED APPLICATIONS

This patent application is a continuation of PCT patent application Ser. No. PCT/EP2002/011355, filed Sep. 10, 2002, which is incorporated by reference.

OBJECT AND BACKGROUND OF THE INVENTION

The present inventions relates generally to a new family of characteristic antenna structures of reduced size featuring a broadband behavior, a multiband behavior of a combination of both effects. The antennas according to the present invention include at least two radiating structures or arms, said two arms being coupled through a specific region of one or both of the arms called the proximity region or close proximity region.

There exists on the prior-art some examples of antennas formed with more than one radiating structure, said structures being electromagnetically coupled to form a single radiating device. One of the first examples would be the Yagi-Uda antenna (see FIG. 1, Drawing 3). Said antenna consists of an active dipole structure, said active dipole structure being fed through a conventional feeding network typically connected at its mid-point, said dipole being coupled to a series of parasitic dipoles of different lengths, said parasitic dipoles being parallel to the active dipole. The skilled in the art will notice that the present invention is essentially different from the Yagi-Uda antenna for several reasons: first of all, because in the Yagi-Uda antenna the distance between any pair of dipoles is generally constant, that is all dipoles are parallel and no proximity region is included to strength the coupling between dipoles. The object of such a coupled parallel dipole arrangement in the Yagi-Uda antenna is to provide an end-fire, directive radiation pattern, while in the present invention the radiating arms are arranged together with the close proximity region to reduce the antenna size yet providing a broadband or multiband behavior.

Another prior-art examples of antennas including two radiating structures coupled together are stacked microstrip patch antennas ("Miniature Wideband Stacked Microstrip Patch Antenna Based on the Sierpinski Fractal Geometry", by Anguera, Puente, Borja, and Romeu. IEEE Antennas and Propagation Society International Symposium, Salt Lake City, USA, July 2000). In such an arrangement, an active microstrip patch of arbitrary shape placed over a groundplane is coupled to a passive parasitic patch placed on top of said active patch. It will be noticed that said active and parasitic patches keep a constant distance between them and are not specifically coupled through a specific proximity region on any of the two patches which were closer the adjacent patch. Such a stacked microstrip patch antenna configuration provides a broadband behavior, but it is does not feature a close proximity region as described in the present invention and it does not feature a highly reduced size, since the patches are typically sized to match a half-wavelength inside the dielectric substrate of the patch, while in the present invention the antennas feature a characteristic small size below a quarter wave-length.

A prior art example of monopole and PIFA antennas which are coupled together to feature a broadband behavior are described in "Realization of Dual-Frequency and Wide-Band VSWR Performances Using Normal-Mode Helical and Inverted-F Antennas", by Nakano, Ikeda, Suzuki, Mimaki, and Yamauchi, IEEE Transactions on Antennas and Propagation, Vol. 46, No 6, June 1998. Again, those examples are clearly different from the antennas described in the present invention because in all of said prior-art arrangements the active elements and the parasitic ones are parallel to each other and do not get the benefit of the close proximity region as disclosed in the present invention, which enhances the broadband behavior while contributing to the antenna miniaturization.

There are some examples of structures in the prior art that include several radiating structures that are not parallel to each other. An example is the V-dipole (see for instance "Antenna Theory, Analysis and Design", by Constantine Balanis, second edition) wherein there is a minimum distance between the two arms at the vertex of the V-shape, but it should be noticed that such a vertex is the feeding point of the structure and does not form a coupling proximity region between said arms as disclosed in the present invention. In the present invention, the feeding point is specifically excluded from the close proximity region since it does not contribute to a size reduction and/or multiband or broadband behavior as it is intended here. To form a dipole according to the present invention, at least one arm of the dipole needs to be folded such that said folded arm approaches the other arm to form the close proximity region.

Other prior-art examples of antennas with multiple radiating arms are multibranch structures (see for instance "Multiband Properties of a Fractal Tree Antenna Generated by Electrochemical Deposition", by Puente, Claret, Sagués, Romeu, López-Salvans, and Pous. IEEE Electronics Letters, vol. 32, No. 5, pp. 2298-2299, December 1996). Again those examples are essentially different to the present invention in which all radiating arms are interconnected through direct ohmic contact to a common conducting structure, while in the present invention at least two of the radiating arms of the antenna must be disconnected and coupled only through said close proximity region.

The skilled in the art will notice that the present invention can be combined with many prior-art antenna configurations to provide new antenna arrangements with enhanced features. In particular, it should be clear that the shape of any of the radiating arms can take many forms provided that at least two arms are included, and said arms include said close proximity region between them. In particular, in several embodiments one or several of the arms according to the present invention take the form of a Multilevel Antenna as described in the Patent Publication No. WO01/22528, a Space-Filling Antenna as described in the Patent Publication No. WO01/54225 or any other complex shape such as meander and zigzag curves. Also, in some embodiments, at least one of the arms approaches an ideal fractal curve by truncating the fractal to a finite number of iterations.

SUMMARY OF THE INVENTION

The present invention consists of an antenna comprising at least two radiating structures, said radiating structures taking the form of two arms, said arms being made of or limited by a conductor, superconductor or semiconductor material, said two arms being coupled to each other through a region on first and second arms such that the combined structure of the coupled two-arms forms a small antenna with a broadband behavior, a multiband behavior or a combination of both effects. According to the present invention, the coupling between the two radiating arms is obtained by means of the shape and spatial arrangement of said two arms, in which at least one portion on each arm is placed in close proximity to each other (for instance, at a distance smaller than a tenth of the longest free-space operating wavelength) to allow electromagnetic fields in one arm being transferred to the other through said specific close proximity regions. Said proximity regions are located at a distance from the feeding port of the antenna (for instance a distance larger than 1/40 of the free-space longest operating wavelength) and specifically exclude said feeding port of the antenna.

Drawings 4 and 5 from FIG. 2 describe examples of antenna devices as described in the present invention. In the particular example of Drawing 4, arms (110) and (111) are L-shaped and coupled trough a close proximity region (200).

In this case, the antenna is mounted on a ground-plane (112) and it is fed at one of the tips (102) of arm (110), while arm (111) is directly connected to ground (103). Although in a very basic configuration, this example contains the essence of the invention (the two arms or radiating structures coupled through a close proximity region (200), defined by folded parts (108) and (109) from arms (110) and (111)). In the particular example of Drawing 5, it can be seen that the position of the proximity region (201) can be placed in other locations. Arm (100) is straight, whereas arm (113) has been folded. The antenna system is mounted on a ground-plane (112) and it is fed at one of the tips (102) or arm (100), whereas arm (113) is connected to ground (103). In both drawings 4 and 5 it can be seen that distance Ws is smaller than distance Wd. Other many embodiments and configurations are allowed within the scope and spirit of the present invention, as it is described in the preferred embodiments.

It must be noticed that, according to the present invention the distance between the two radiating arms cannot be constant since at least a proximity region needs to be formed in a portion of the two arms to enhance the coupling from one arm to the other, according to the present invention. In other words, the distance between said two arms in the direction that is orthogonal to any of the arms is not constant throughout all the arms. This specifically excludes any antenna made of two radiating arms that run completely in parallel at a constant distance between them (such as the examples shown in FIG. 1).

The feeding mechanism of the present invention can take the form of a balanced or unbalanced feed. In an unbalanced embodiment, the feeding port (102) is defined between at least one point in a first of two said arms ((110) or (100)) and at least one point on a ground plane (112) or ground counterpoise (see for instance (102) in FIG. 1). In this unbalanced case, arm (111) or (113) is shorted to said ground plane or ground counterpoise (112). Also, in this unbalanced feeding scheme the proximity region ((200) and (201)) is clearly distinguished within the structure because the minimum distance between arms Ws in said proximity region is always smaller than the distance Wd between the feeding point (102) in said first arm ((110) or (100)) and the grounding point (103) at said second arm ((111) or (113)).

In a balanced scheme (see for instance Drawing 75 from FIG. 17), one point at each of the two radiating structures or arms defines the differential input port (183) between said two arms (182, 184). In this case, the proximity region excludes such a differential feed region and it is located at a distance larger than 1/40 of the free-space operating wavelength from said feed region. Again, it must be noticed that in this arrangement the distance between said arms (182, 184) cannot be constant and will typically include two close regions: the feeding region (183) defining said differential input, and the proximity region which is characteristic of the present invention.

One important aspect of the present invention is that no contact point exists between the two radiating arms defining the antenna. Said two arms form two separated radiating elements, which are coupled by the characteristic close proximity region, but no ohmic contact between said two arms is formed. This specifically excludes from the present invention any antenna formed by a single radiating multibranch structure where two or several of the radiating arms on said multibranch structure can be coupled through a proximity region. The difference between the present invention and said multibranch structures is obvious, since in a multibranch structure all radiating arms or branches are connected in direct ohmic contact to a single conducting structure, while the present invention is specifically made of at least two separated radiating structures with no direct contact among them.

Regarding the shape of the radiating arms of the antenna, they can take any form as long as they include the characteristic proximity region between them. In some embodiments L or U shaped arms are preferred. In other embodiments the arms take the form of complex multilevel and space-filling structures, and even in some embodiments one or two of the arms approach the shape of a fractal form. In fact, the shape of the arms is not a differential aspect of the invention; the differential aspect of the invention is the proximity region that provides a strong coupling between the otherwise independent radiating arms.

It can be noticed that the scope of the present invention is not limited to structure formed by two radiating arms. Three or more radiating arms can be included within the invention as long as at least two of them define a close proximity region as described above. In some embodiments, multiple arms are coupled together through a single close proximity region. In other embodiments, the some of the several arms are coupled together through several proximity regions.

The main advantages of the present invention with respect to other prior art antennas are:

(a) A reduced size or height with respect to other quarter-wavelength resonating elements.

(b) A broadband behavior with typical bandwidths around 50% and beyond.

(c) A better return-loss and voltage standing wave ratio (VSWR) at the input port.

(d) An enhanced radiation efficiency compared to other antennas of the same size.

(e) An enhanced gain compared to other antennas of the same size.

The skilled in the art will notice that, obviously, such advantages can be combined with other features, for instance, a multiband response. The skilled in the art will notice that such a multiband response can be obtained within the present invention by adjusting the length and size of the several-coupled arms, together with the spacing and size of the proximity region defined between the several arms. Another way of combining said advantages with a multiband behavior consists of shaping at least one of the arms as a multiband antenna, for instance by means of a multilevel structure or a space-filling structure.

Depending on the arrangement and application, the arms of the present invention can take the form of any of the prior art antennas, including monopoles, dipoles, planar inverted-F (PIFA) and inverted-F (IFA) structures, microstrip structures, and so on. Therefore, the invention is not limited to the aforementioned antennas. The antenna could be of any other type as long as the antenna includes at least two radiating arms or structures, and that those arms define a close proximity region where the distance between arms reaches a minimum value.

It will be clear that depending on the antenna embodiment included in the present invention, the resulting antenna would be suitable for several environments. In particular, the antennas can be integrated in handheld terminals (cellular or cordless telephones, PDAs, electronic pagers, electronic games, or remote controls), in cellular or wireless access points (for instance for coverage in micro-cells or pico-cells for systems such as AMPS, GSM850, GSM900, GSM1800, UMTS, PCS1900, DCS, DECT, WLAN, . . . ), in car antennas, in integrated circuit packages or semiconductor devices, in multichip modules, and so on.

BRIEF DESCRIPTION OF THE DRAWINGS

For a better understanding of the present invention, reference will now be made to the appended drawings in which:

FIG. 15 shows more examples of applications where coupled antennas can be mounted. Drawings 70 and 72 show basic configurations of coupled antennas mounted on handheld PCBs. Drawing 71 shows a clamshell handheld configuration (folded PCB) and how the coupled antenna could be mounted on, that.

DETAILED DESCRIPTION OF THE PREFERRED EMBODIMENTS

In order to construct a coupled antenna system according to embodiments of the invention, a suitable antenna design is required. Any number of possible configurations exists, and the actual choice of antenna is dependent, for instance, on the operating frequency and bandwidth, among other antenna parameters. Several possible examples of embodiments are listed hereinafter. However, in view of the foregoing description, it will be evident to a person skilled in the art that various modifications may be made within the scope of the invention. In particular, different materials and fabrication processes for producing the coupled antenna system may be selected, which still achieve the desired effects.

Figure 1:
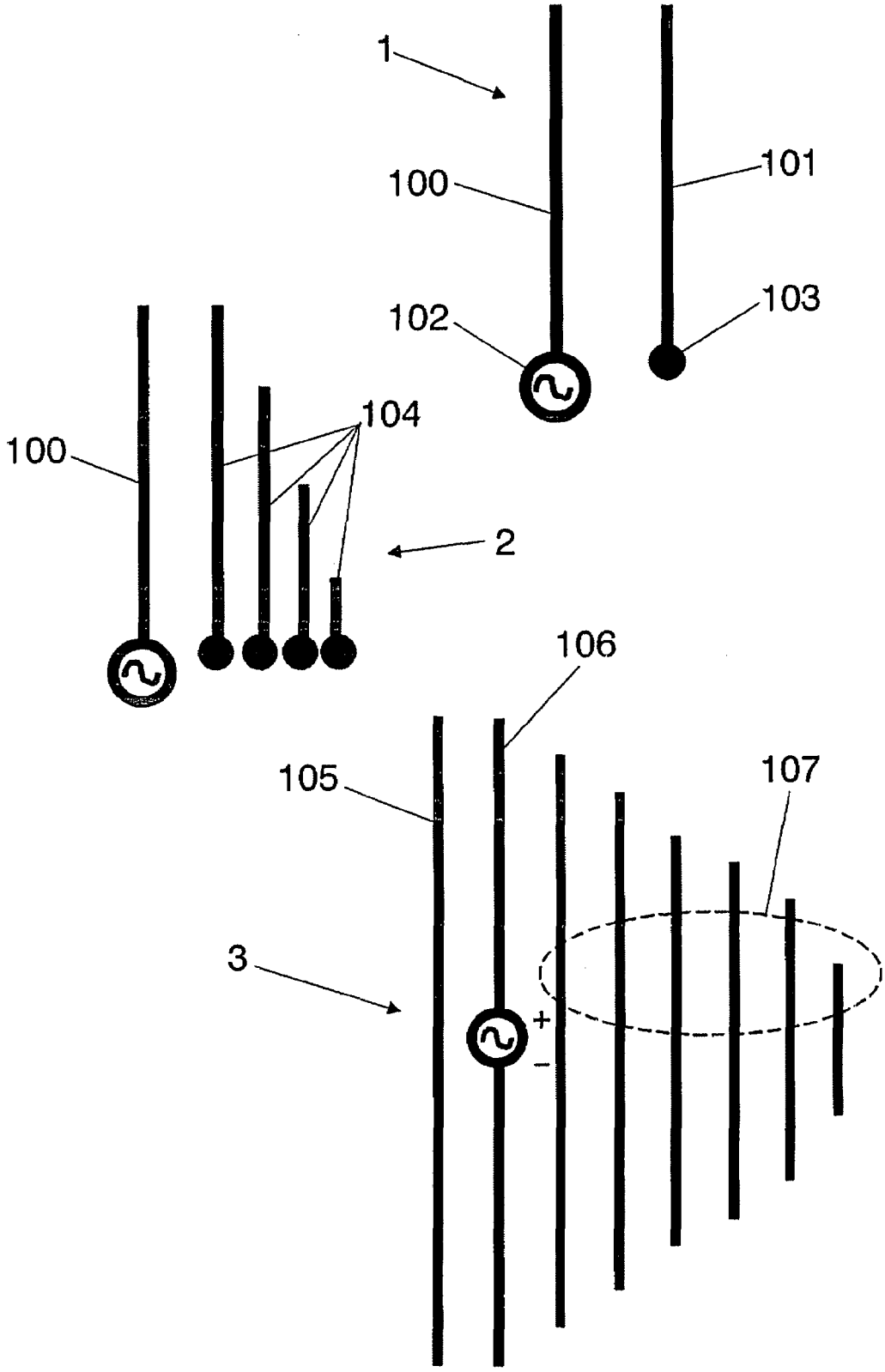
FIG. 1 (Prior Art)
FIG. 1 shows different prior-art configurations. Drawing 1 shows a conventional active monopole (unbalanced antenna connected to a feed point) with a parallel parasitic element, whereas Drawing 2 shows a conventional active monopole (unbalanced antenna connected to a feed point) with four conventional straight parasitic elements, all of them parallel to the active monopole. Drawing 3 shows a very well-known prior-art configuration known as Yagi-Uda, used mainly for terrestrial communications. With this Yagi-Uda configuration, several parasitic elements are placed in parallel to the active element and at the same distance to each other.

Drawing 1 from FIG. 1 shows in a manner already known in prior-art an antenna system formed by two monopoles, one acting as the active monopole (100) and the other acting as the parasitic monopole (101). The feed point (102), represented with a circle in all the drawings in the present invention, can be implemented in several ways, such a coaxial cable, the sheath of which is coupled to the groundplane, and the inner conductor of which is coupled to the radiating conductive element (100). Parasitic element (101) is connected to groundplane through (103). In this configuration, there is no close proximity region, since both (100) and (101) are in parallel. The radiating conductive element (100) is usually shaped in prior art like a straight wire, but several other shapes can be found in other patents or scientific articles. Shape and dimensions of radiating element (100) and parasitic element (101) will contribute in determining the operating frequency of the overall antenna system.

Drawing 2 from FIG. 1 shows also in a manner known in prior-art an antenna system formed by a radiating element (100) and several parasitic monopoles (104). In this configuration, there is no close proximity region, since both the radiating element (100) and the parasitic elements (104) are in parallel.

Drawing 3 from FIG. 1 shows a prior-art configuration known as Yagi-Uda. With this structure, the distance between any pair of dipoles is generally constant, that is, all the dipoles (105, 106, 107) are parallel and no proximity region is included to strength the coupling between dipoles. The object of such a parallel dipole arrangement in the Yagi-Uda antenna is to provide an end-fire, directive radiation pattern, whereas in the present invention the radiating arms are arranged together with the close proximity region to reduce the antenna size yet providing a broadband or multiband behavior.

Figure 2:
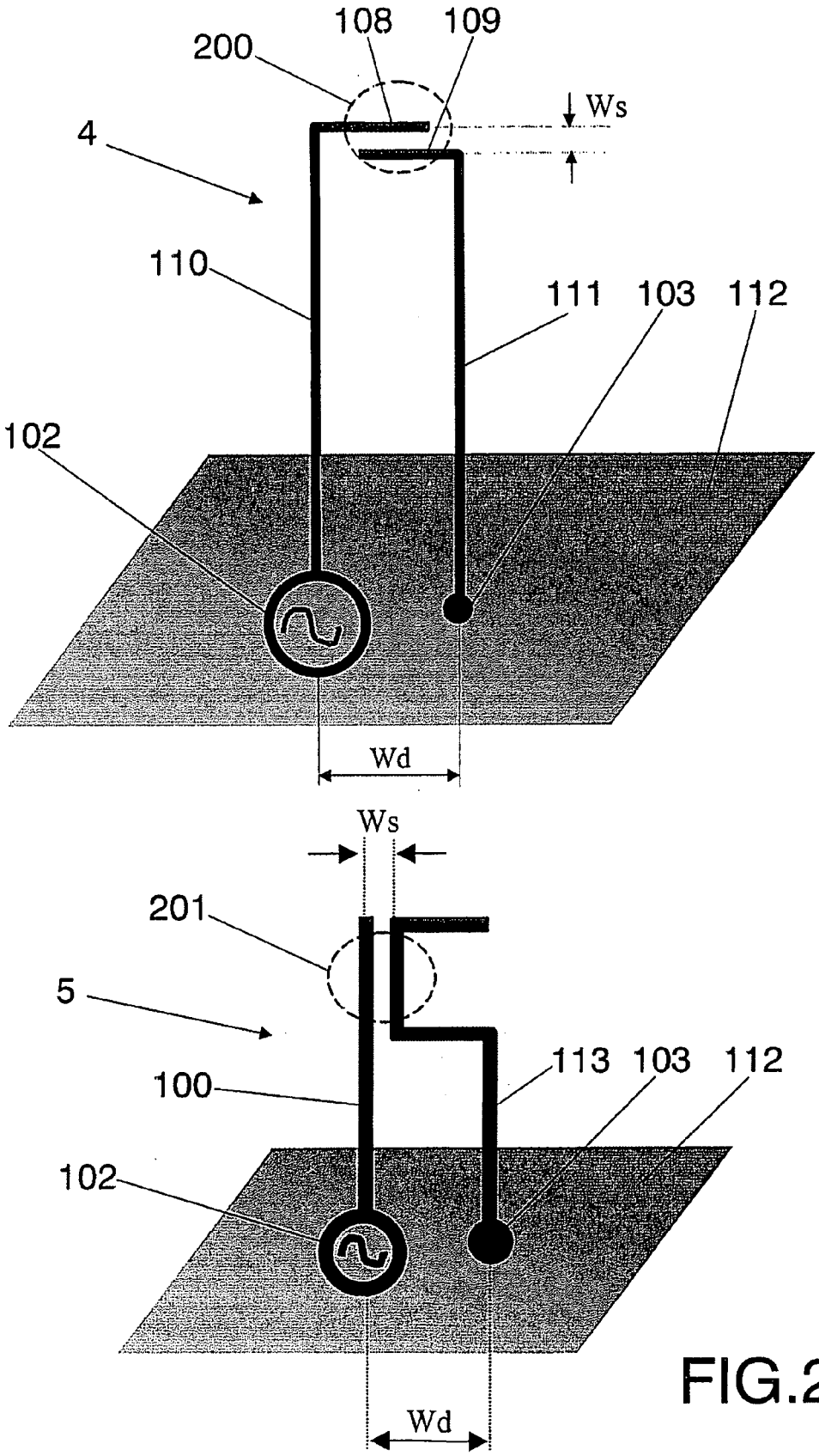
FIG. 2 shows two basic structures for what is covered with this invention. Drawing 4 shows two arms, one of them is fed, and the other one is directly connected to ground. It can be seen that there is a close proximity region between them. Both arms are folded in this example. Drawing 5 shows another configuration for the two arms, wherein the arm that is fed is straight, whereas the parasitic arm is folded so as to form a close proximity region with said first arm.

Unlike the prior art structures illustrated in FIG. 1, the newly disclosed coupled antenna system shown in FIG. 2, Drawing 4, is composed by a radiating element (110) connected to a feeding point (represented by (102)) and a parasitic element (111) connected to the groundplane (112) through (103). It is clear in this configuration the close proximity region (200) between folded subpart arms (108) and (109). That is, Ws<Wd. Feeding point (102) can be implemented in several ways, such a coaxial cable, the sheath of which is coupled to the groundplane (112), and the inner conductor of which is coupled to the radiating conductive element (110). Shape and dimensions of radiating element (110) and parasitic element (111) will contribute in determining the operating frequency of the overall antenna system. For the sake of clarity but without loss of generality, a particular case is showed in Drawing 5. It is composed by a radiating element (100) connected to a feeding point (102), and a parasitic element (113) connected to the groundplane (112) through (103). It is clear in this configuration also that the close proximity region (201) between (100) and (113) contributes to the enhanced performance of the antenna system, and that Ws<Wd. It is clear to those skilled in the art that these configurations in FIG. 2 could have been any other type with any size, and being coupled in any other manner as long as the close proximity region is formed, as it will be seen in the following preferred embodiments. For the sake of clarity, the resulting monopole structures are lying on a common flat groundplane, but other conformal configurations upon curved or bent surfaces for both the coupled antennas and the groundplanes could have been used as well. The ground-plane (112) being showed in the drawing is just an example, but several other groundplane embodiments known in the art or from previous patents could have been used, such as multilevel or space-filling groundplanes, or Electromagnetic Band-Gap (EBG) groundplanes, or Photonic Band-Gap (PBG) groundplanes, or high-impedance (Hi-Z) groundplanes. The ground-plane can be disposed on a dielectric substrate. This may be achieved, for instance, by etching techniques as used to produce PCBs, or by using a conductive ink.

Figure 3:
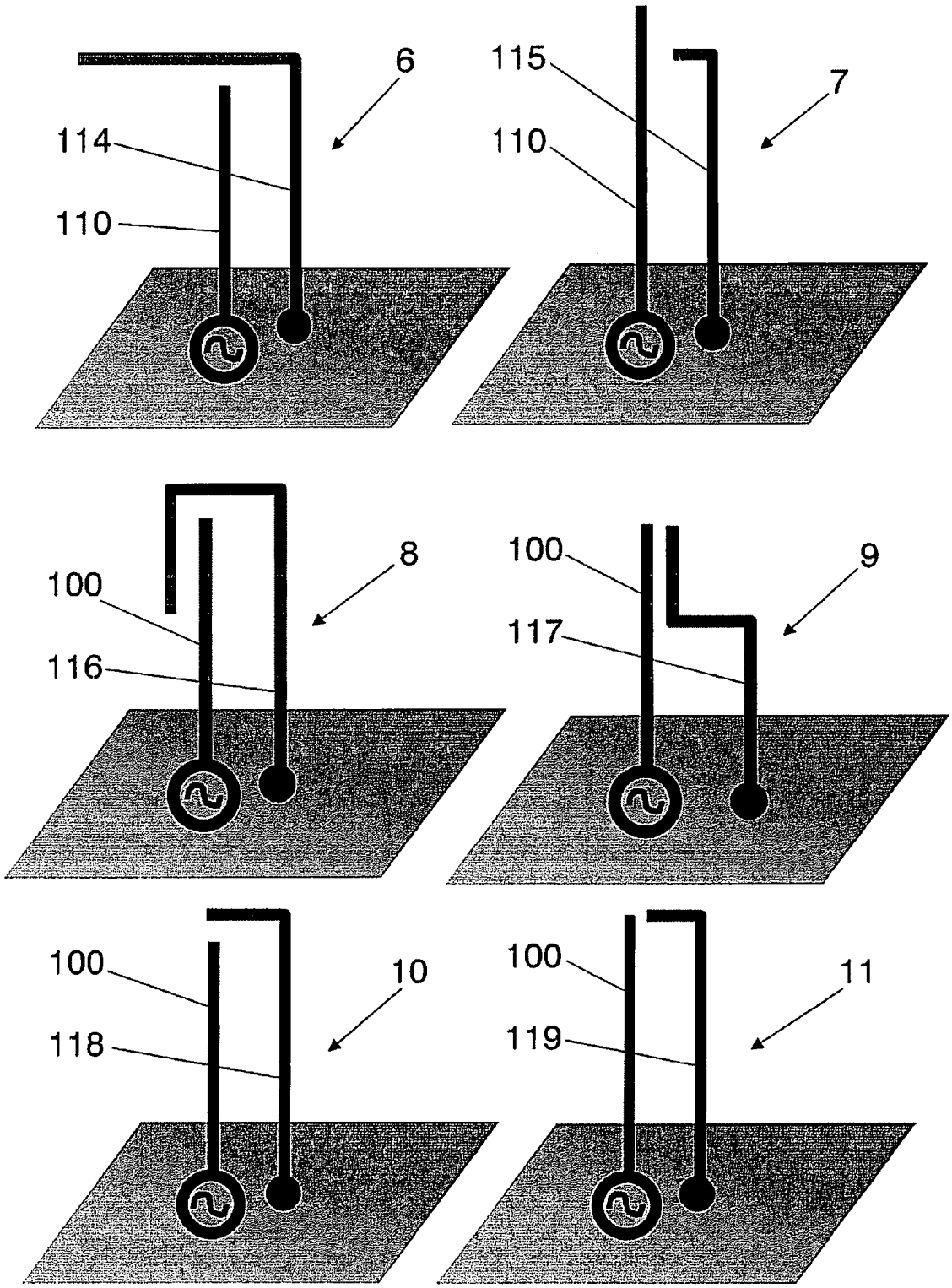
FIG. 3 shows several basic examples of different configurations for coupled antennas, where the arms that are connected to the feeding point (active arms) are straight, whereas the parasitic arms are folded so as to form a close proximity region with the active arms.

In some preferred embodiments, such as the ones being showed in FIG. 3, only the parasitic elements (114, 115, 116, 117, 118, 119) are folded so as to form a close proximity region between radiating elements (100) and parasitic elements (114, 115, 116, 117, 118, 119). Basic configurations (Drawings 6 to 11) are being illustrated in this Figure, where folding of the parasitic elements (114, 115, 116, 117, 118, 119) is formed by 90-degree angles. The described embodiments of this figure are presented by way of example only and do not limit the invention. Having illustrated and described the principles of the invention in several preferred embodiments thereof, it should be readily apparent to those skilled in the art that the invention can be modified in arrangement and detail without departing from the close proximity region principle.

Figure 4:
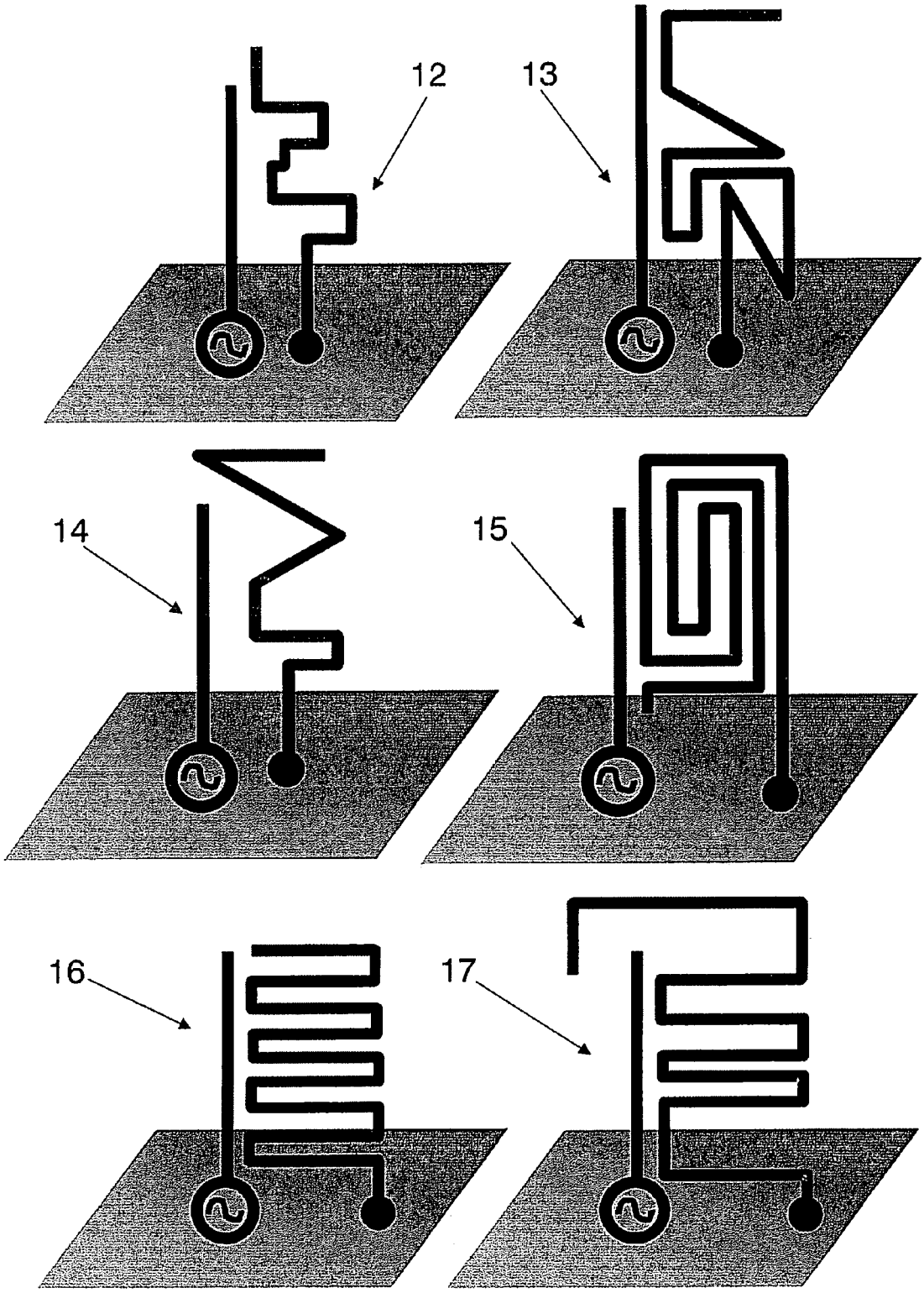
FIG. 4 shows a series of more complex examples of coupled antennas, where the arms that are connected to the feeding point (active arms) are straight, whereas the parasitic arms can be folded with space-filling curves.

Some embodiments, like the ones being showed in FIG. 4, where space-filling curves are coupled, are preferred when a multiband or broadband behavior is to be enhanced. Said space-filling arrangement allows multiple resonant frequencies which can be used as separate bands or as a broadband if they are properly coupled together. Also, said multiband or broadband behavior can be obtained by shaping said elements with different lengths within the structure. Space-filling curves is also a way to miniaturize further the size of the antenna. For the sake of clarity but without loss of generality, particular configurations are being showed in this figure, where the active elements (that is, the radiating arms) are straight, whereas the space-filling properties have been utilized in the parasitic elements. However, the same space-filling principle could have been used to the radiating elements, as it will be shown in other preferred embodiments described later in this document.

Figure 5:
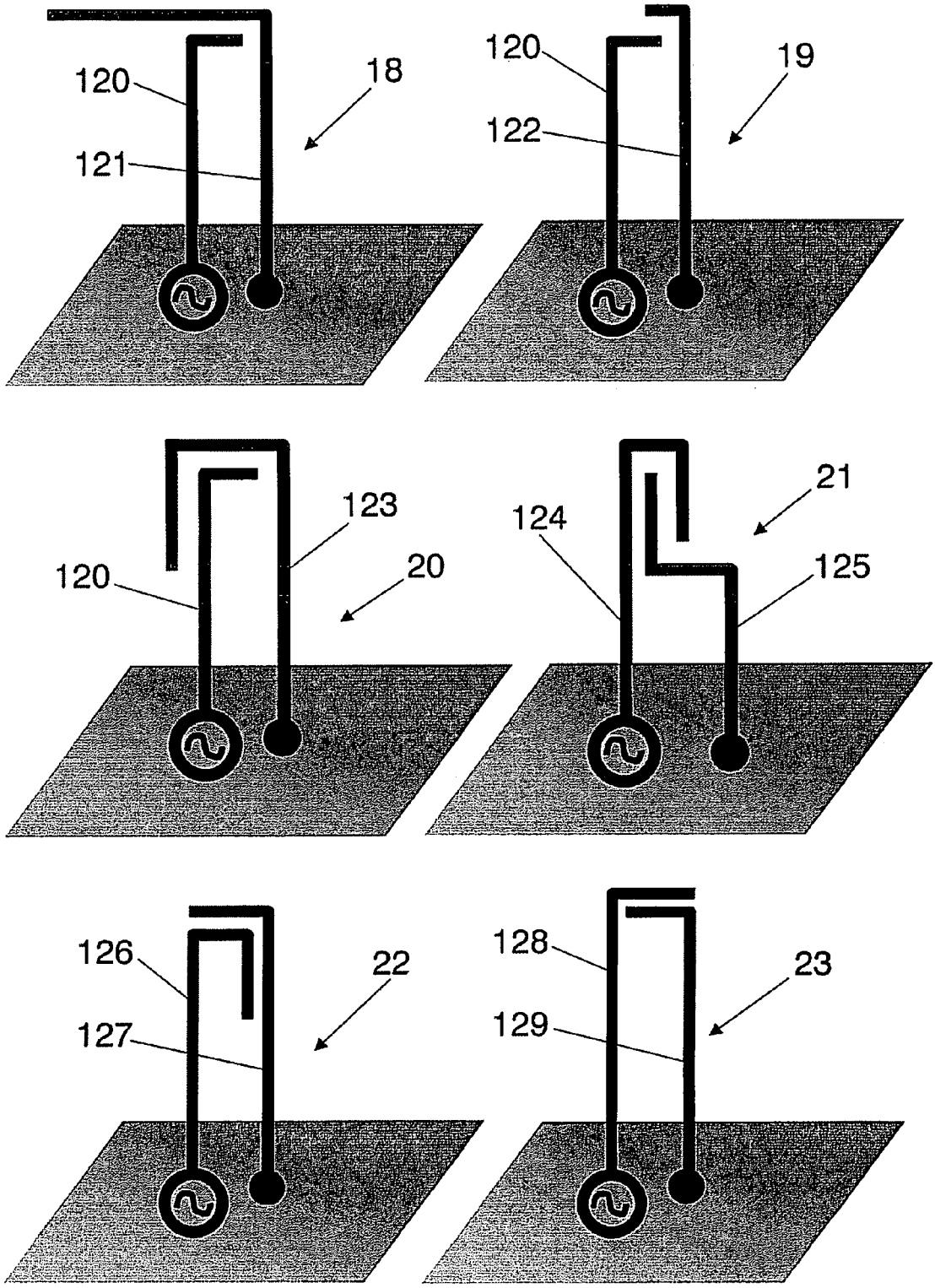
FIG. 5 shows that not only the parasitic arms can be folded so as to form a close proximity region, but also the active arms, that is, the arms that are connected to groundplane. Basic configurations are shown in this figure.

In some preferred embodiments, such as the ones being showed in FIG. 5, both the parasitic elements (121, 122, 123, 125, 127, 129) and the radiating/active elements (120, 124, 126, 128) are folded so as to form a close proximity region between said radiating elements (120, 124, 126, 128) and said parasitic elements (121, 122, 123, 125, 127, 129). Basic configurations (Drawings 18 to 23) are being illustrated in this figure, where folding of the parasitic elements (121, 122, 123, 125, 127, 129) and radiating elements (120, 124, 126, 128) is formed by 90-degree angles. The described embodiments of this figure are presented by way of example only and do not limit the invention. Having illustrated and described the principles of the invention in several preferred embodiments thereof, it should be readily apparent to those skilled in the art that the invention can be modified in arrangement and detail without departing from the close proximity region principle.

Figure 6:
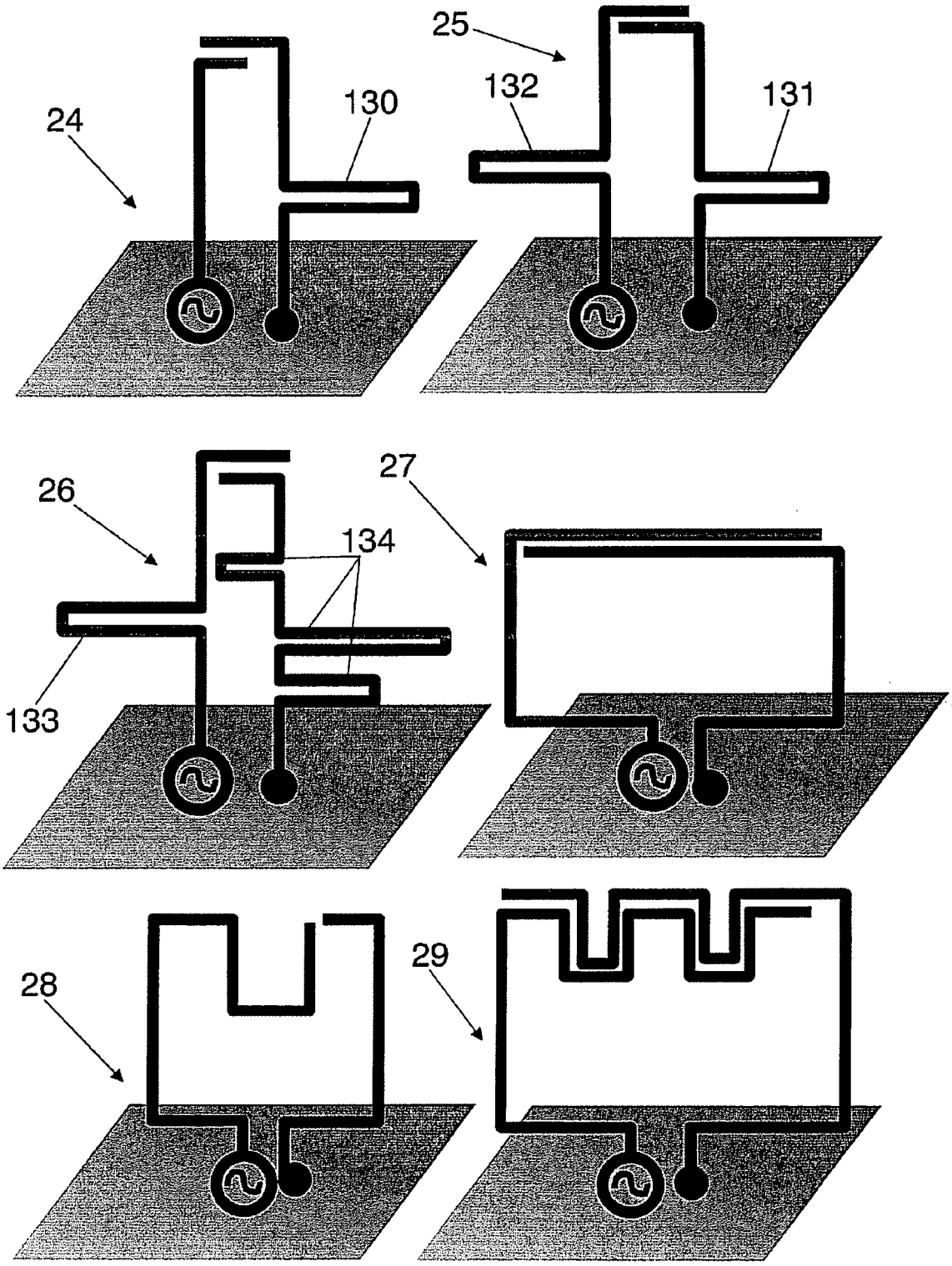
FIG. 6 shows alternative schemes of coupled antennas. Drawings 24, 25, and 26 are examples of coupled antennas where either one of two arms have parts acting as stubs, for better matching the performance of the antenna to the required specifications. Drawings 27, 28, and 29 show examples of how coupled-loop structures can be done by using the present invention.

For the preferred embodiments showed in Drawings 24, 25, and 26 from FIG. 6, the arms are being formed by means of using inductive stubs (130, 131, 132, 133, 134). The purpose of those is further reduce the size of the antenna system. The position of said stubs can be placed and distributed along the radiating or the parasitic arms.

In some preferred embodiments, loop configurations for the coupled antennas further help matching the operating frequencies of the antenna system, such as the ones showed in Drawings 27, 28, and 29 in FIG. 6. From these drawings it can be seen that the overall shape of the antenna system forms an open loop, yet still being within the scope of the present invention without departing from the close proximity region principle.

Figure 7:
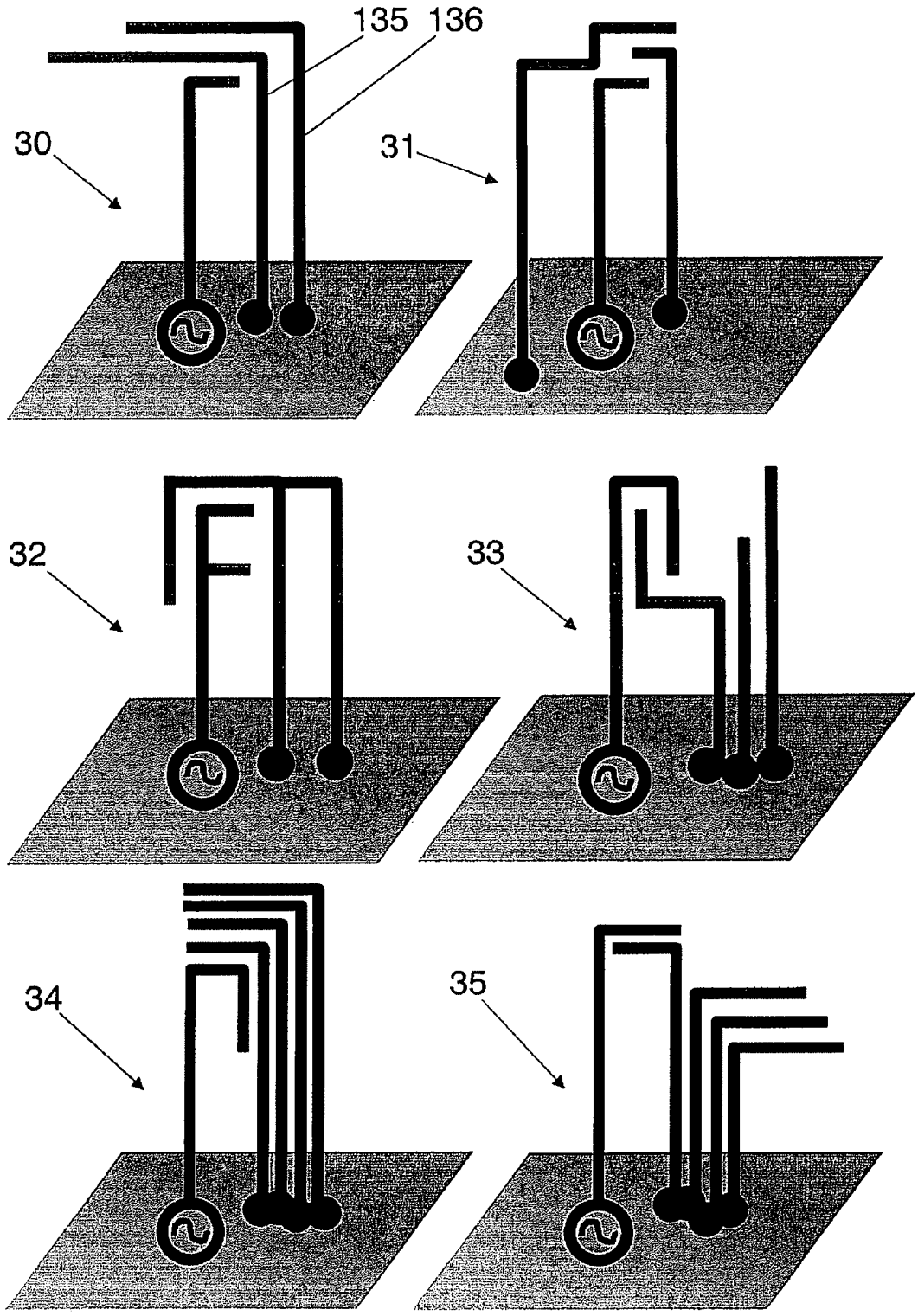
FIG. 7 shows that several parasitic arms (that is, arms that are not connected to the feeding port) can be placed within the same structure, as long as there is a close proximity region as defined in the object of the invention.

To illustrate that several modifications of coupled antenna systems can be done based on the same principle and spirit of the present invention, other preferred embodiment examples are shown in FIG. 7. Drawing 30 shows a structure where two parasitic elements (135, 136) are included, and a close proximity region is being formed between the active element and the parasitic subsystem. Drawings 31 to 35 show other preferred configurations where several parasitic elements with different shapes have been placed in different locations and distribution.

Figure 8:
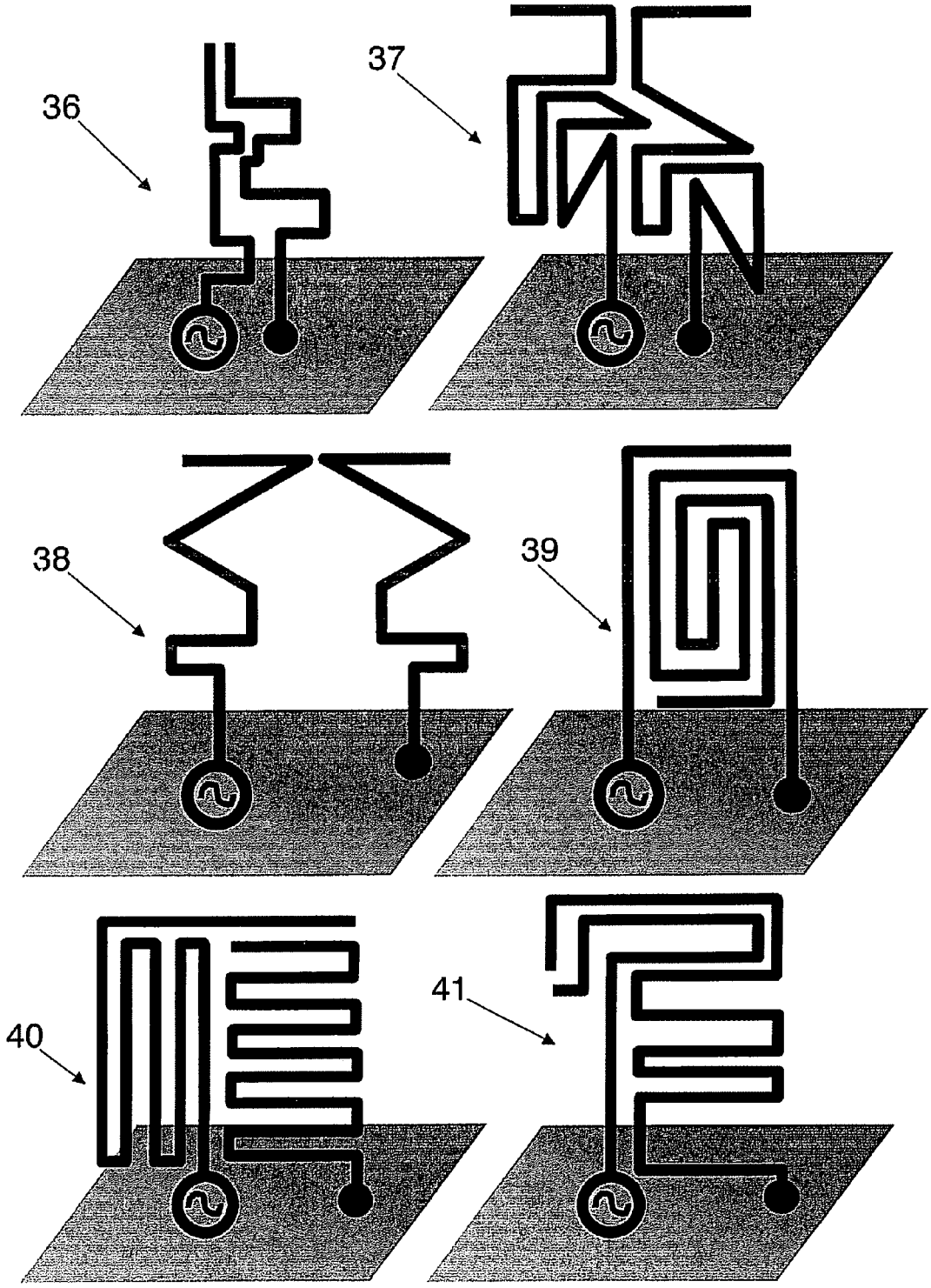
FIG. 8 shows different configurations of arms formed by space-filling curves. As in previous examples, no matter how the arms are built, the close proximity region is well defined.

Some embodiments, like the ones being showed in FIG. 8, where space-filling curves are coupled, are preferred when a multiband or broadband behavior is to be enhanced. Said space-filling arrangement allows multiple resonant frequencies which can be used as separate bands or as a broadband if they are properly coupled together. Also, said multiband or broadband behavior can be obtained by shaping said elements with different lengths within the structure. Space-filling curves is also a way to miniaturize further the size of the antenna. For the sake of clarity but without loss of generality, particular configurations are being showed in this figure, where the both the active elements (that is, the radiating arms) and the parasitic elements are being formed by means of space-filling curves.

Figure 9:
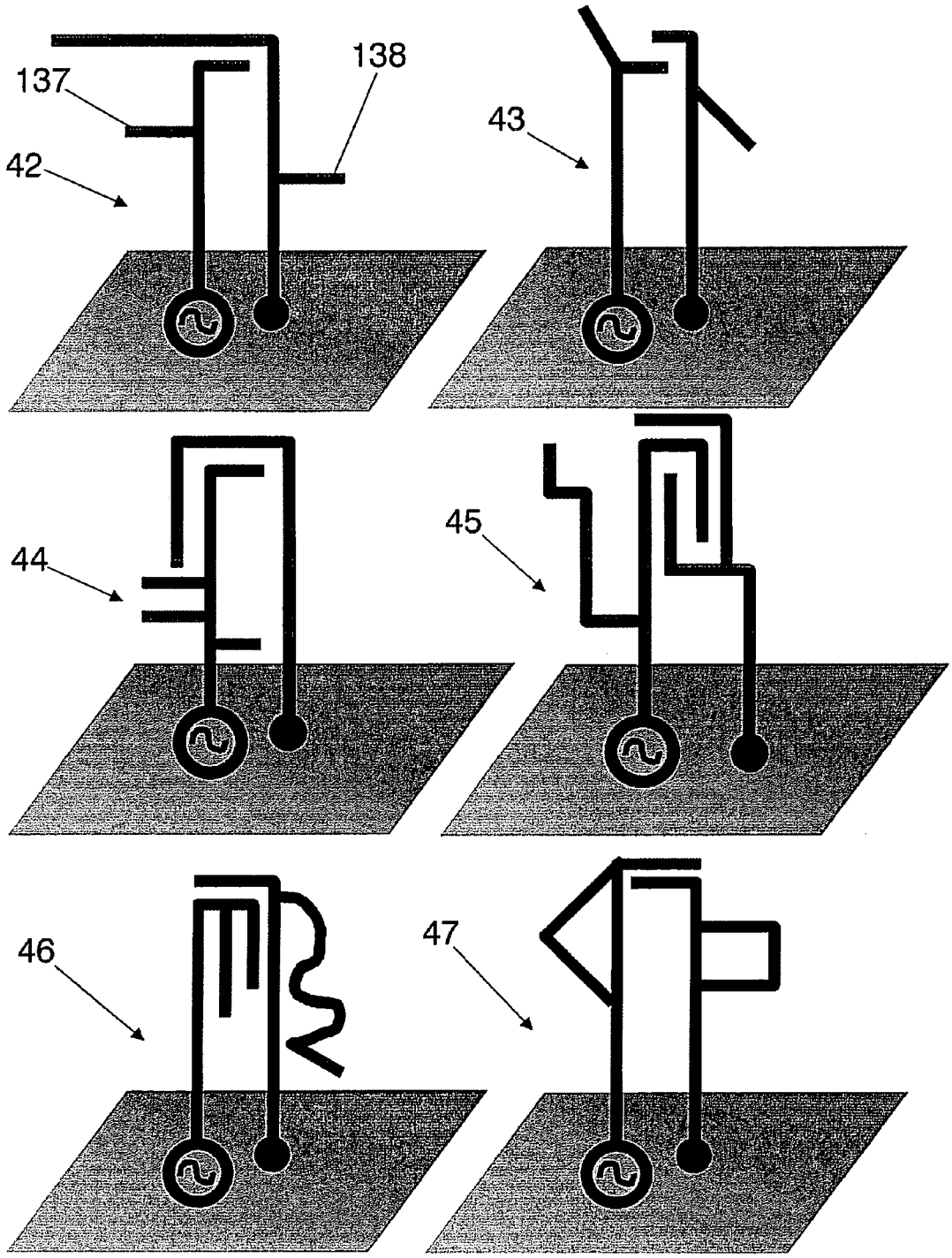
FIG. 9 shows another set of examples where arms include one or several sub-branches to their structure, so as to better match the electrical characteristics of the antenna with the specified requirements.

In some preferred embodiments, sub-branches to the parasitic and the active elements need to be added so as to match the frequency response of the antenna to the required specifications. Drawing 42 in FIG. 9 shows a configuration where a branch (137) has been added to the active element, and another branch (138) has been added to the parasitic element. The shape and size of the branch could be of any type, such as linear, planar or volumetric, without loss of generality. Drawings 43 to 47 in FIG. 9 show other examples of coupled antennas with a branch-like configuration.

Figure 10:
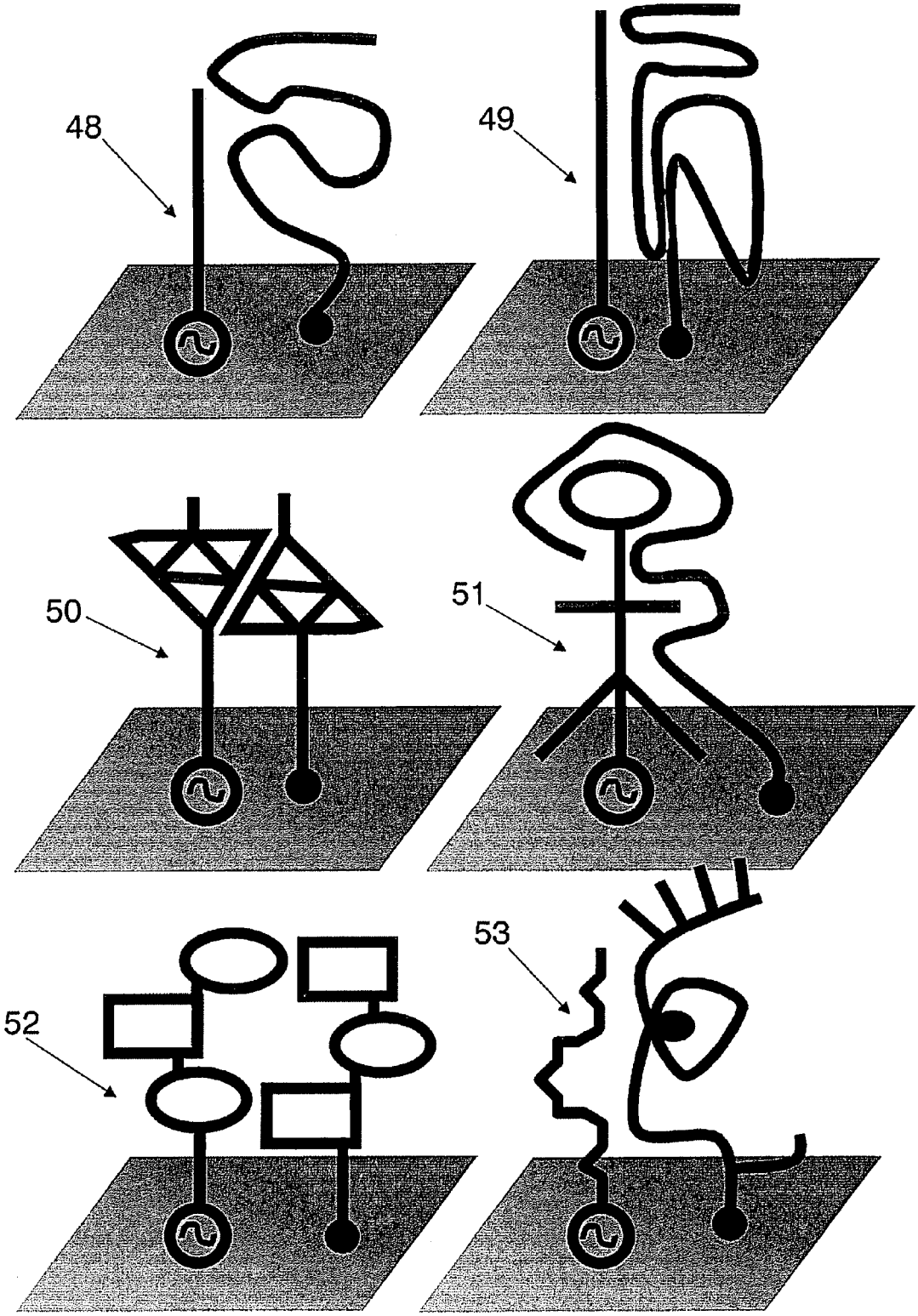
FIG. 10 shows several complex configurations of coupled antennas, with combinations of configurations previously seen in FIGS. 1-9.

It is interesting to notice that the advantage of the coupled antenna geometry can be used in shaping the radiating elements and the parasitic elements in very complex ways. Particular examples of coupled antennas using complex configuration and designs are being showed in Drawings 48 to 53 in FIG. 10, but it appears clear to any skilled in the art that many other geometries could be used instead within the same spirit of the invention.

Figure 11:
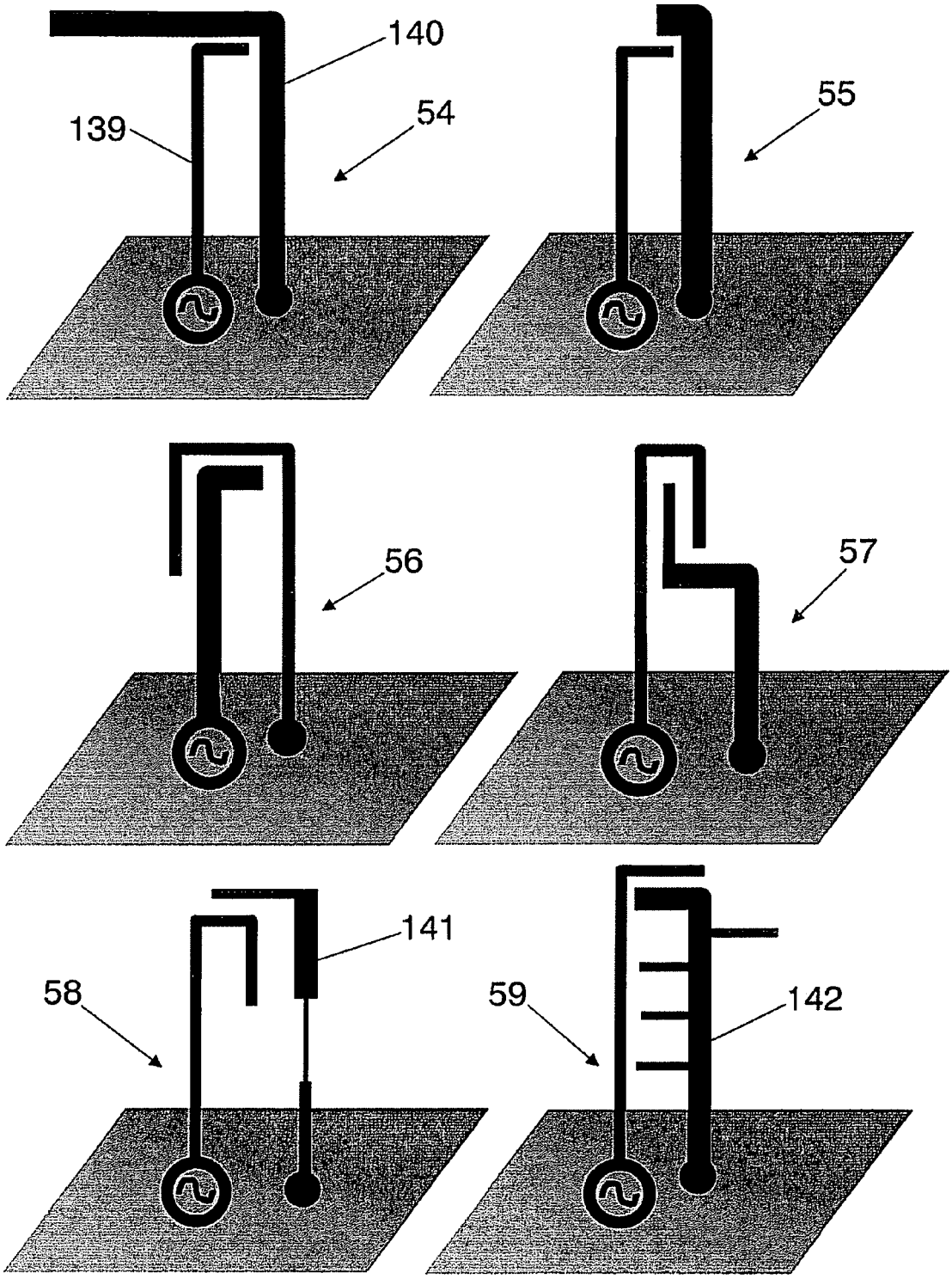
FIG. 11 shows that any shape of the arm can be used, as long as the coupled antennas are connected through a close proximity region.

The shape and size of the arms could be of any type, such as linear, planar or volumetric, without loss of generality. Drawings 54 to 59 in FIG. 11 show several examples of coupled antennas where shape of both radiating and parasitic elements varies within the same element.

Figure 12:
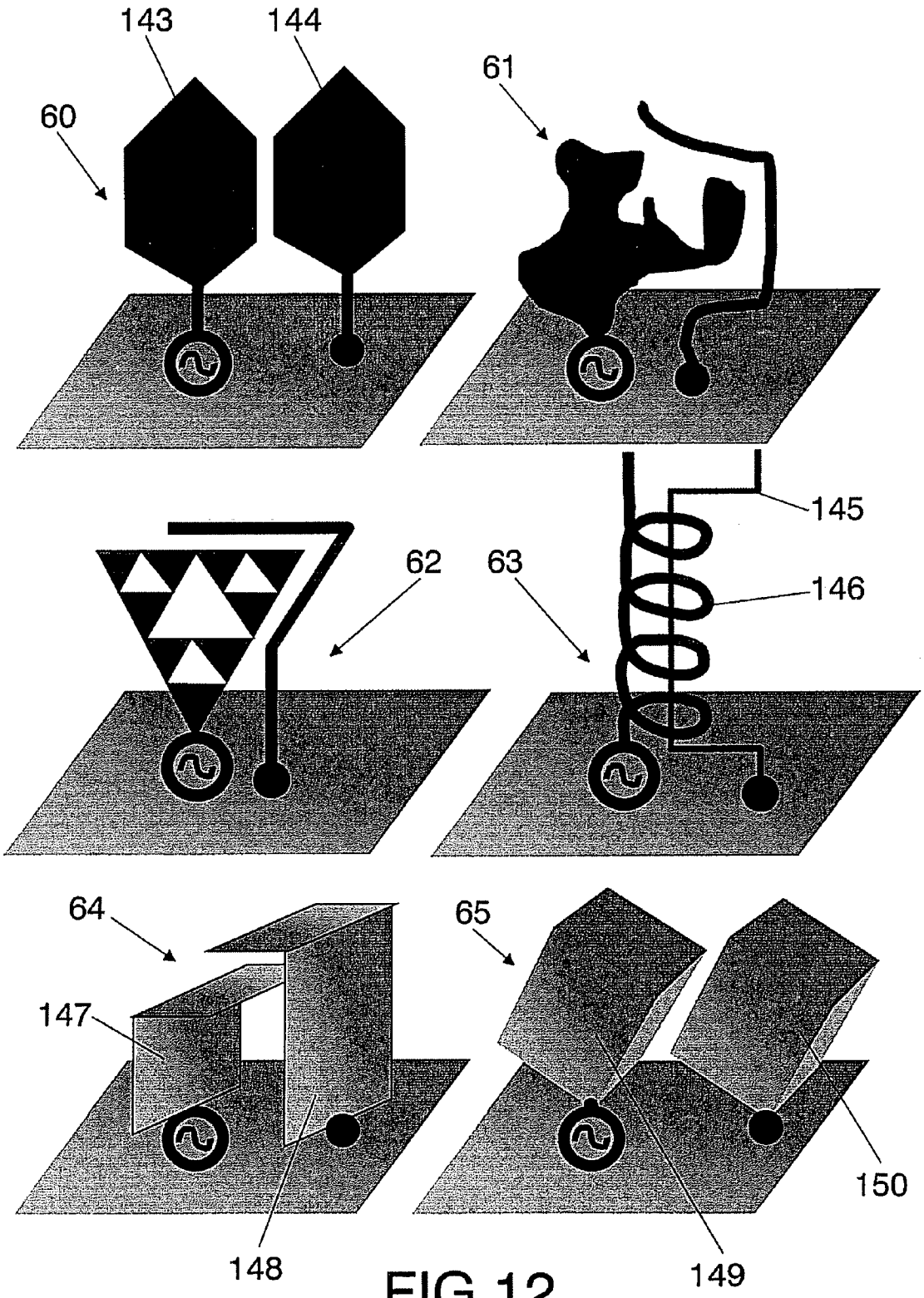
FIG. 12 shows a series of complex examples of coupled antennas. Drawings 60 and 61 show that arms can also be formed by planar structures. Drawing 62 shows an active arm formed by a multilevel structure. Drawing 63 shows a spiral active arm surrounding the parasitic arm. Drawing 64 shows another example of planar arms folded. Not only linear or planar structures are covered within the scope of the present invention, as seen in Drawing 65, where two 3D arms are positioned so as to form a close proximity region.

FIG. 12 shows that not only linear structures can be adapted to meet the close proximity region principle defined in the scope of this invention. Drawing 60 shows an example of two planar elements (143, 144). Drawing 62 shows an example of a multilevel structure acting as the radiating element. Drawing 63 shows a spiral active arm surrounding the parasitic arm. Drawing 64 shows another example of planar arms folded. Not only linear or planar structures are covered within the scope of the present invention, as seen in Drawing 65, where two 3D arms are positioned so as to form a close proximity region.

Figure 13:
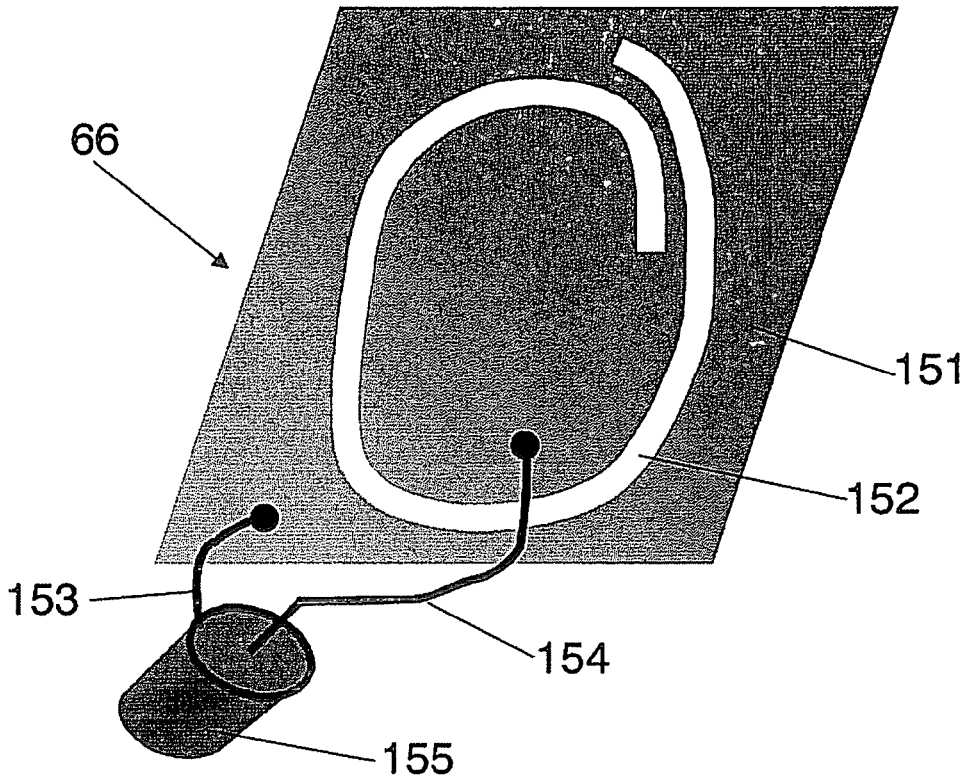
FIG. 13 shows that not only monopoles can feature a close proximity region, but also slot antennas, such as the ones showed in Drawings 66 and 67.
Figure 13:
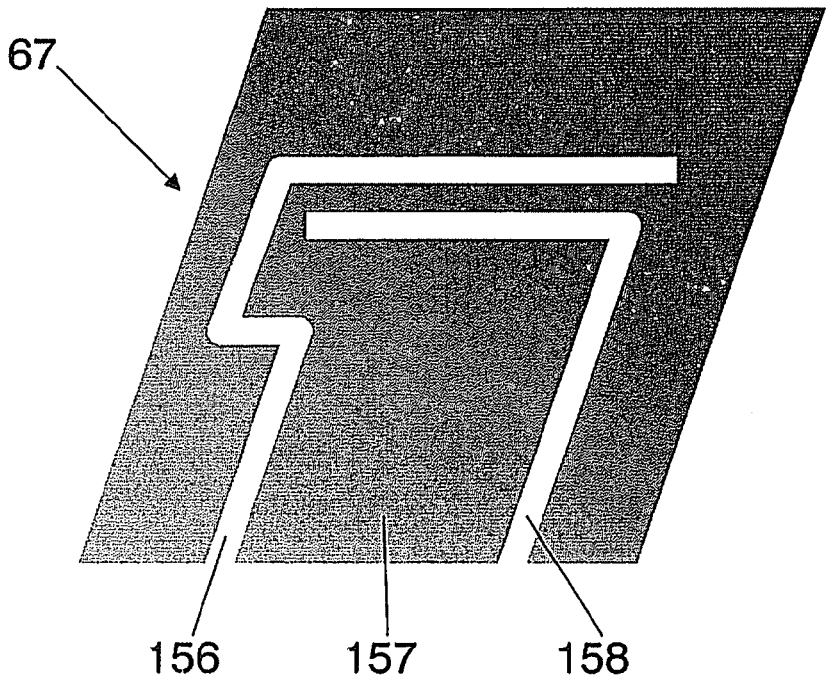

FIG. 13 shows that not only monopoles or dipoles can feature a close proximity region, but also slot antennas, such as the ones showed in Drawings 66 and 67. Both drawings are being composed by a conventional solid surface ground-plane (151) that has been cut-out so as to have some slots on it (152, 156, 158). The feedpoint (155) can be implemented in several ways, such as a coaxial cable, the sheath (153) of which is connected to the external part of (151), and the inner conductor (154) of the coaxial cable is coupled to the inner radiating conductive element, as shown in Drawing 66. In the case of Drawing 67, the inner conductor of the coaxial cable would be connected to (157).

Figure 14:
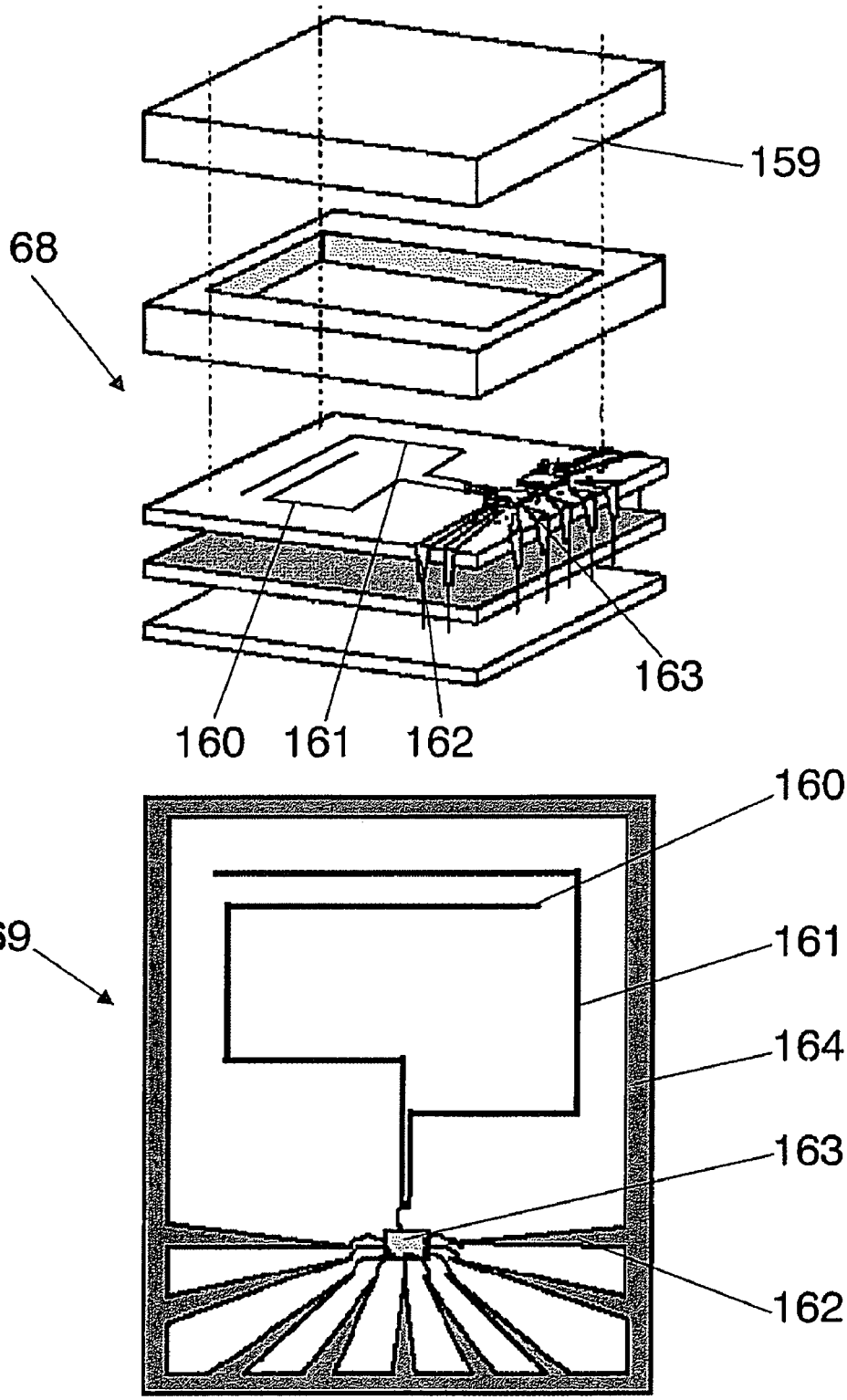
FIG. 14 shows a coupled antenna mounted on a chip configuration.

Another preferred embodiment of coupled antennas is the one being showed in FIG. 14. The Drawing represents a coupled antenna being placed in an IC (or chip) module, and is composed by a top cover (159), by an transmit/receive IC module (163), by bond wires (162), by the lead frame of the chip (164), and by a coupled antenna, being formed by an active element and a parasitic element (160, 161). Any other type of chip technology could been used without loss of generality.

Figure 15:
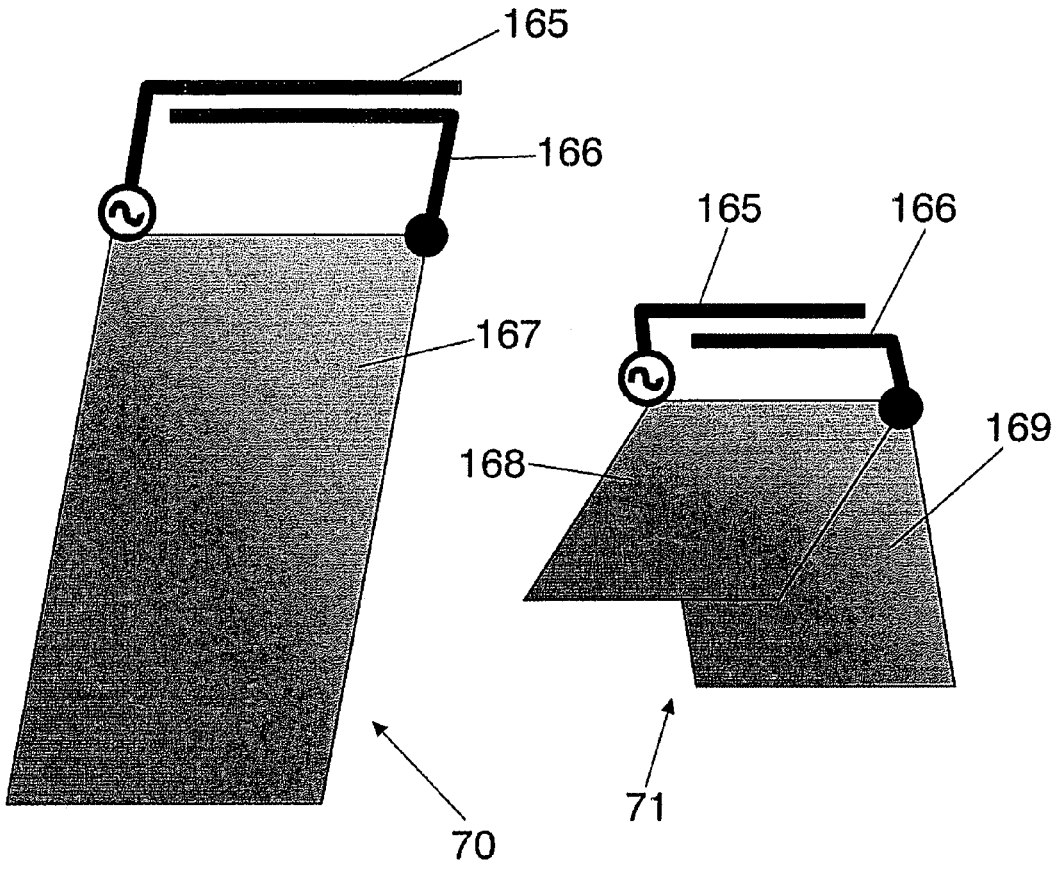
Figure 15:
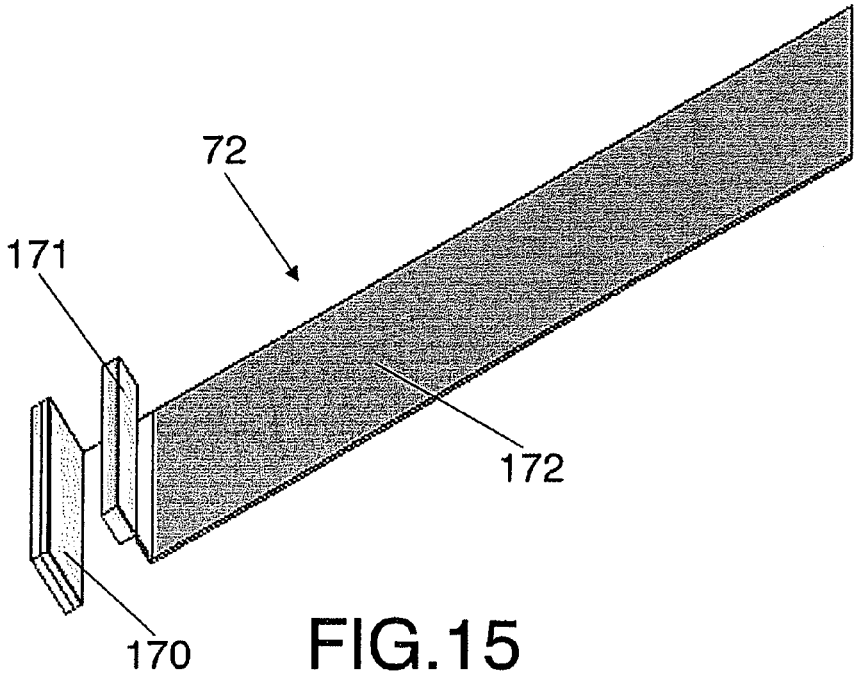

FIG. 15 shows different configurations of handheld applications where coupled antennas, as described in the present invention, can be used. Drawing 70 shows a PCB (167) of a handheld device (for instance, a cell phone) that acts as groundplane. Just for the sake of clarity, the antenna system in this example is formed by two arms, one acting as active (165), that is, connected to the feeding point, and the other one acting as parasitic (166). Drawing 71 shows a clamshell configuration (also known as flip-type) for a cell phone device, and where the antenna system presented in this invention could be located at. Drawing 72 shows a PCB (172) of a handheld device (for instance, a cell phone) that acts as groundplane. The antenna system in this example is formed by two arms that are, in this specific case, 3D structures, once acting as the active arm (171) and the other one acting as the parasitic arm (170). Here, the arms (170, 171) of the antenna system are presented as a parallelepipeds, but any other structure can be obviously taken instead.

Figure 16:
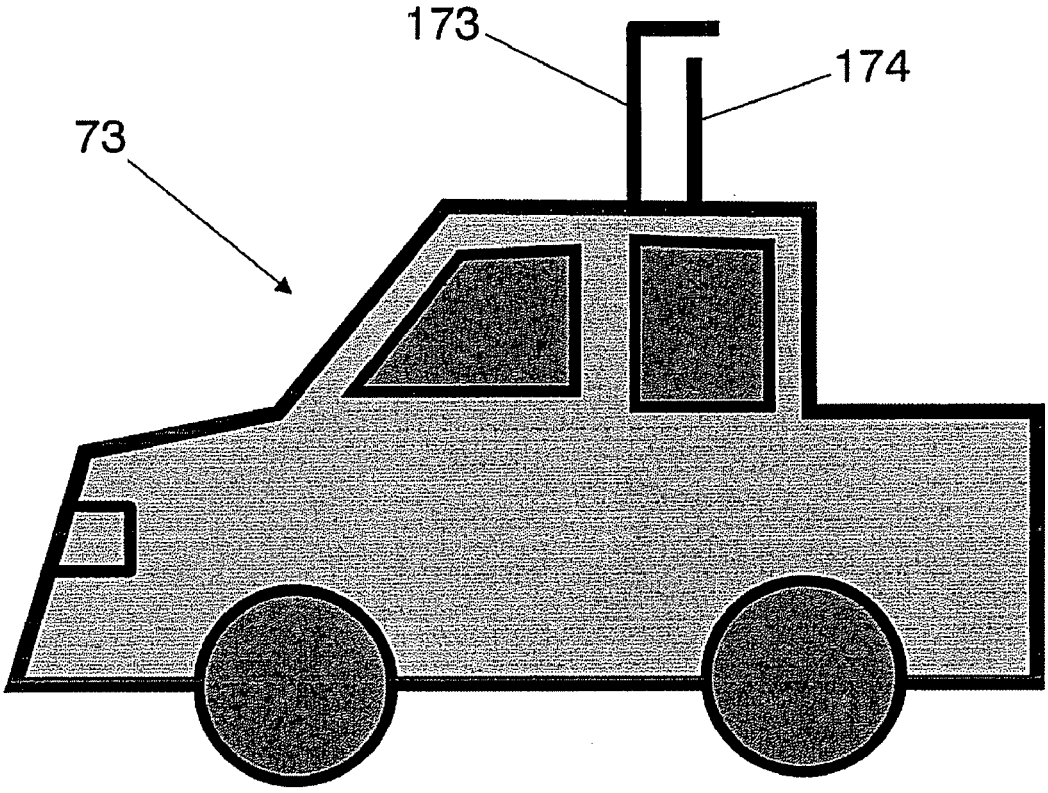
FIG. 16 shows another configuration for coupled antennas, where those are connected in a car environment.

Another preferred embodiment is the one shown in FIG. 16, where the coupled antenna system (173, 174) is mounted on or in a car.

Figure 17:
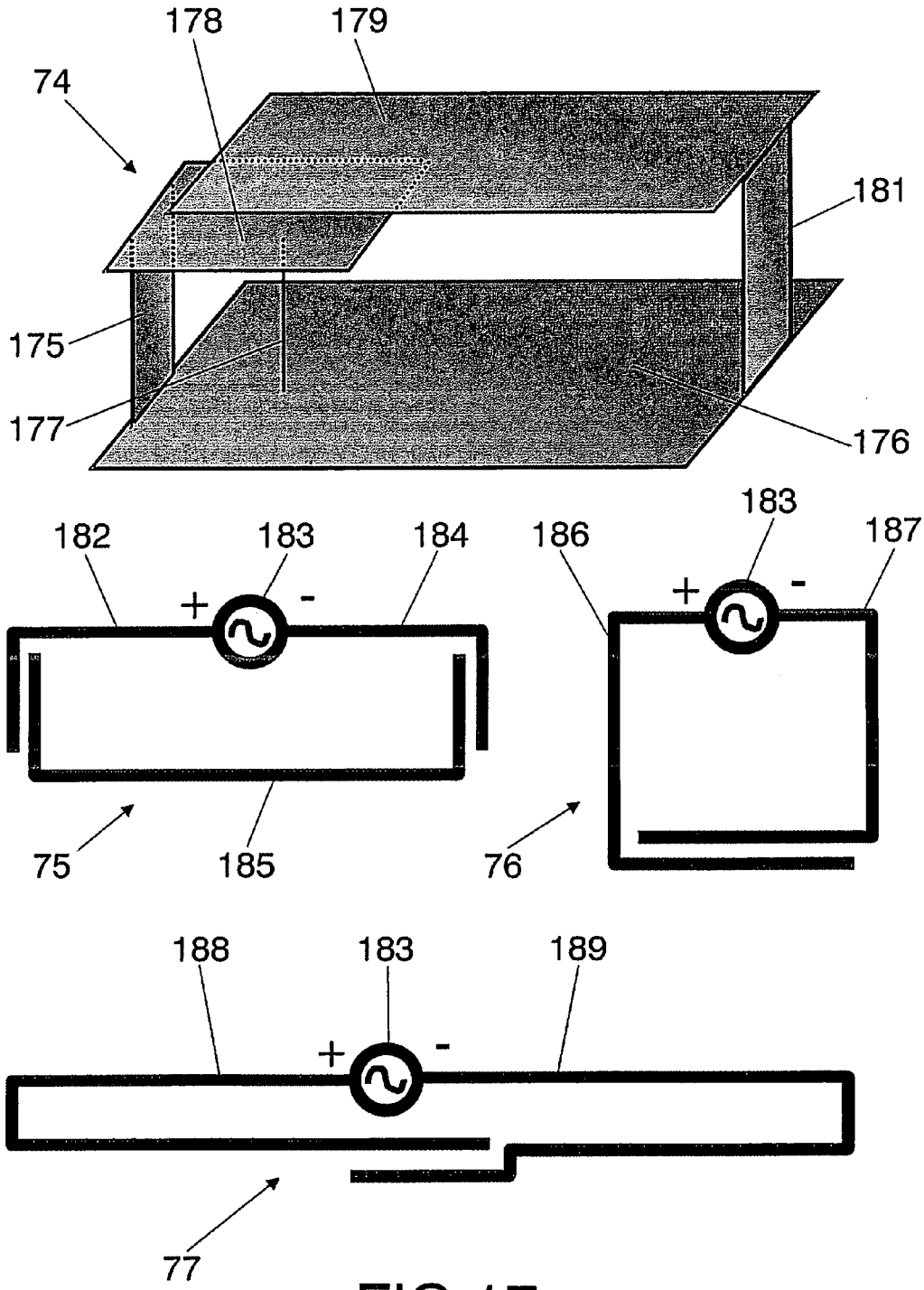
FIG. 17, Drawing 74 shows a PIFA structure that is also covered within the scope of the present invention, since it features a close proximity region between the two arms (in this case, two planar patches) of the structure. Drawings 75, 76, and 77 show a series of dipole structures (balanced feeding structure) that also feature a close proximity region.

FIG. 17, Drawing 74 shows a PIFA structure that is being composed by an active element formed by groundplane (176), a feeding point (177) coupled somewhere on the patch (178) depending upon the desired input impedance, a grounding or shorting point connection (175), and a radiator element (178). Also, the system is being formed by a parasitic element (179) that is connected to groundplane as well (181). In Drawing 74 it can be clearly seen that the close proximity region is formed by elements (178) and (179). PIFA antennas have become a hot topic lately due to having a form that can be integrated into the per se known type of handset cabinets. Preferably, for this type of antenna system, the antenna, the ground-plane or both are disposed on a dielectric substrate. This may be achieved, for instance, by etching techniques as used to produce PCBs, or by printing the antenna and the ground-plane onto the substrate using a conductive ink. A low-loss dielectric substrate (such as glass-fibre, a Teflon substrate such as Cuclad® or other commercial materials such as Rogers® 4003 well-known in the art) can be placed between said patches and ground-plane. Other dielectric materials with similar properties may be substituted above without departing from the intent of the present invention. As an alternative way to etching the antenna and the ground-plane out of copper or any other metal, it is also possible to manufacture the antenna system by printing it using conductive ink. The antenna feeding scheme can be taken to be any of the well-known schemes used in prior art patch or PIFA antennas as well, for instance: a coaxial cable with the outer conductor connected to the ground-plane and the inner conductor connected to the patch at the desired input resistance point; a microstrip transmission line sharing the same ground-plane as the antenna with the strip capacitively coupled to the patch and located at a distance below the patch, or in another embodiment with the strip placed below the ground-plane and coupled to the patch through a slot, and even a microstrip transmission line with the strip co-planar to the patch. All these mechanisms are well known from prior art and do not constitute an essential part of the present invention. The essential part of the present invention is the shape of the proximity close region, which contributes to reducing the size with respect to prior art configurations, as well as enhancing antenna bandwidth, VSWR, and radiation efficiency.

Drawings 75 to 77 in FIG. 17 show configurations of coupled antennas as described in the object of the present invention, but with balanced feeding points (183).

The above-described embodiments of the invention are presented by way of example only and do not limit the invention. Having illustrated and described the principles of our invention in several preferred embodiments thereof, it should be readily apparent to those skilled in the art that the invention can be modified in arrangement and detail without departing from such principles.

The invention claimed is:

1. An antenna device comprising:

at least two radiating arms;

a ground plane;

a first arm of the at least two radiating arms includes first and second ends and a feeding point at the first end;

a second arm of the at least two radiating arms includes first and second ends and a grounding point at the second end;

wherein the at least two radiating arms are coupled by at least one close proximity region, said at least one close proximity region being formed by a portion between said two arms in which a distance between at least a first point in said first arm and at least a second point in the second arm is smaller than a distance between said feeding point and the grounding point and the at least one close proximity region does not intersect a projection orthogonal to the ground plane;

wherein the antenna does not include a contact point between said first arm and said second arm; and wherein said antenna is a monopole antenna.

2. The antenna device according to claim 1, wherein the distance between said first and second points is shorter than a tenth of a longer free-space operating wavelength.

3. The antenna device according to claim 1, wherein:

said first arm includes a feeding port at the first end, said feeding port being formed by at least a point in said first arm and at least a point on the ground-plane or a ground counterpoise; and wherein said second end of said second arm is connected to said ground-plane or the ground counterpoise.

4. The antenna device according to claim 3, wherein the distance between a region adjacent the second end of the first arm and a region adjacent the first end of the second arm is smaller than the distance between the feeding point on the first arm and the grounding point on the second arm.

5. The antenna device according to claim 3, wherein:

at least one of the arms include one bend, said bend defining an angle smaller than 90° with respect to a normal direction to a plane;

said plane including the feeding point in the first arm and being orthogonal to the ground plane at the feeding point;

said plane excluding the grounding point on the second arm of the antenna; and wherein said normal to said plane being a vector pointing to a semispace over said plane including said grounding point on said second arm.

6. The antenna device according to claim 1, wherein a portion of the at least one arm is formed after 2 to 9 connected segments, each of said segments forming an angle with their neighboring connected segments, said angle being smaller than 180° degrees, said segments being shorter than ⅓ of a longer free-space operating wavelength.

7. The antenna device according to claim 1, wherein a portion of the at least one arm is formed after ten or more connected segments, each of said segments forming an angle with their neighboring connected segments, said angle being smaller than 180° degrees, said segments being shorter than ⅛ of a longer free-space operating wavelength.

8. The antenna device according to claim 1, wherein: a portion of the at least one arm includes a set of conductor, superconductor or semiconductor polygons, all of said polygons featuring same number of sides;

wherein said polygons are electromagnetically coupled either by a capacitive coupling or ohmic contact; and wherein a contact region between directly connected polygons is narrower than 50% of a perimeter of said polygons in at least 75% of said polygons defining a conducting ground-plane.

9. The antenna device according to claim 1, wherein the at least one arm is formed by a polygonal surface enclosing a conducting, superconducting or semiconducting material.

10. The antenna device according to claim 1, wherein at least a portion of said first and second arms are lying on two parallel surfaces, said surfaces being spaced by a dielectric material.

11. The antenna device according to claim 1, wherein: at least a portion of said first and second arms have a substantially planar shape;

said portions being mounted orthogonally to a rectangular or elongated ground plane at a distance smaller than ⅓ of a free-space operating wavelength from a shorter side or edge of said ground plane;

said portions of said first and second arms being substantially parallel to said edge of said ground-plane;

said first arm including said feeding point, said feeding point being located near a corner of said ground plane at a distance smaller than a tenth of the free-space operating wavelength; and said second arm being connected to said ground plane near an opposite corner on the shorter edge of said ground plane at a distance smaller than a tenth of the free-space operating wavelength.

12. The antenna device according to claim 11, wherein:

the planar portion of said first arm is closer to the edge of said ground plane than the planar portion of said second arm; and said first arm includes the feeding point, while the second arm is shorted to the ground plane.

13. The antenna device according to claim 1, wherein said first and second arms are planar and parallel to the ground plane.

14. The antenna device according to claim 1, wherein said first and second arms are planar and parallel to the ground plane and are printed in at least one layer of the sides of a single layer or a multilayer printed circuit board, said printed circuit board also including said ground plane.

15. The antenna according to claim 1, wherein the antenna features a voltage standing wave ratio (VSWR) below 2 within the 800 MHz to 2500 MHz frequency range.

16. The antenna according to claim 1, wherein said antenna is integrated inside a package of an integrated circuit or chip, such that at least one of the arms of said antenna is printed in at least one layer of a substrate supporting a semiconductor die.

17. The antenna according to claim 1, wherein the at least two arms and the ground plane are enclosed inside a plastic or dielectric package, said package being mounted on a glass surface of a motor vehicle, said antenna operating from 800 MHz to 2500 MHz frequency range.

18. The antenna according to claims 1, wherein the ground plane is a PBG (Photonic Band-Gap) ground plane, or a EBG (Electromagnetic Band-Gap) ground plane, or a Hi-Z (High Impedance) ground plane.

19. The antenna according to claim 1, wherein at least one of the at least two radiating arms include one or more sub-branches.

20. The antenna according to claim 1, wherein at least one of the at least two radiating arms has one or more parts acting as stubs.

21. The antenna according to claim 1, wherein said first and second radiating arms are 3D structures.

22. The antenna according to claim 1, wherein the antenna device is a handheld communication device.

23. The antenna according to claim 22, wherein the handheld communication device is a flip-type phone.

24. The antenna according to claim 23, wherein the first and second arms are located near a hinge of the flip-type phone.

25. The antenna according to claim 1, wherein the at least one arm has a substantially linearshape.

26. An antenna device comprising:

a first radiating arm;

a second radiating arm;

a ground plane;

said first radiating arm including first and second ends and a feeding point at the first end;

said second radiating arm including first and second ends and a grounding point at the second end;

wherein the distance between a first point in said first radiating arm and a second point in said second radiating arm is smaller than a distance between any third point on said first radiating arm and any fourth point on said second radiating arm;

wherein said third and fourth points are located at a distance away from the feeding or the grounding point of said first and second arms;

wherein a line between the first point and the second point does not intersect an orthogonal projection of the ground plane;

wherein said distance between said third and fourth points is longer than 1/40 of a free-space operating wavelength;

wherein the antenna does not include a contact point between said first arm and said second arm; and wherein said antenna is a monopole antenna.

27. The antenna device according to claim 26, wherein:

said first arm includes a feeding port at the first end, said feeding port being formed by at least a point in said first arm and at least a point on the ground-plane or ground counterpoise; and wherein said second end of said second arm is connected to said ground-plane or the ground counterpoise.

28. The antenna device according to claim 27, wherein the distance between a region adjacent the second end of the first arm and a region adjacent the first end of the second arm is smaller than the distance between the feeding point on the first arm and the grounding point on the second arm.

29. The antenna device according to claim 27, wherein:

at least one of the arms include one bend, said bend defining an angle smaller than 90° with respect to a normal direction to a plane;

said plane including the feeding point in the first arm and being orthogonal to the ground plane at the feeding point; and said plane excluding the grounding point on the second arm of the antenna; and wherein said normal to said plane being a vector pointing to a semispace over said plane including said grounding point on said second arm.

30. The antenna device according to claim 26, wherein a portion of the at least one arm is formed after 2 to 9 connected segments, each of said segments forming an angle with their neighboring connected segments, said angle being smaller than 180° degrees, said segments being shorter than 1/3 of a longer free-space operating wavelength.

31. The antenna device according to claim 26, wherein a portion of the at least one arm is formed after ten or more connected segments, each of said segments forming an angle with their neighboring connected segments, said angle being smaller than 180° degrees, said segments being shorter than 1/8 of a longer free-space operating wavelength.

32. The antenna device according to claim 26, wherein:

a portion of the at least one arm includes a set of conductor, superconductor or semiconductor polygons, all of said polygons featuring same number of sides;

wherein said polygons are electromagnetically coupled either by a capacitive coupling or ohmic contact; and wherein a contact region between directly connected polygons is narrower than 50% of a perimeter of said polygons in at least 75% of said polygons defining a conducting ground-plane.

33. The antenna device according to claim 26, wherein the at least one arm is formed by a polygonal surface enclosing a conducting, superconducting or semiconducting material.

34. The antenna device according to claim 26, wherein at least a portion of said first and second arms are lying on two parallel surfaces, said surfaces being spaced by a dielectric material.

35. The antenna device according to claim 26, wherein:

at least a portion of said first and second arms have a substantially planar shape;

said portions being mounted orthogonally to a rectangular or elongated ground plane at a distance smaller than 1/3 of a free-space operating wavelength from a shorter side or edge of said ground plane;

said portions of said first and second arms being substantially parallel to said edge of said ground-plane;

said first arm including said feeding point, said feeding point being located near a corner of said ground plane at a distance smaller than a tenth of the free-space operating wavelength; and said second arm being connected to said ground plane near an opposite corner on the shorter edge of said ground plane at a distance smaller than a tenth of the free-space operating wavelength.

36. The antenna device according to claim 35, wherein:

the planar portion of said first arm is closer to the edge of said ground plane than the planar portion of said second arm; and said first arm includes the feeding point, while the second arm is shorted to the ground plane.

37. The antenna device according to claim 26, wherein said first and second arms are planar and parallel to the ground plane.

38. The antenna device according to claim 26, wherein said first and second arms are planar and parallel to the ground plane and are printed in at least one layer of the sides of a single layer or a multilayer printed circuit board, said printed circuit board also including said ground plane.

39. The antenna device according to claim 26, wherein the antenna features a voltage standing wave ratio (VSWR) below 2 within the 800 MHz to 2500 MHz frequency range.

40. The antenna according to claim 26, wherein said antenna is integrated inside a package of an integrated circuit or chip, such that at least one of the arms of said antenna is printed in at least one layer of a substrate supporting a semiconductor die.

41. The antenna according to claim 26, wherein the at least two arms and the ground plane are enclosed inside a plastic or dielectric package, said package being mounted on a glass surface of a motor vehicle, said antenna operating from 800 MHz to 2500 MHz frequency range.

42. The antenna according to claims 26, wherein the ground plane is a PBG (Photonic Band-Gap) ground plane, or a EBG (Electromagnetic Band-Gap) ground plane, or a Hi-Z (High Impedance) ground plane.

43. The antenna according to claim 26, wherein at least one of the at least two radiating arms include one or more sub-branches.

44. The antenna according to claim 26, wherein at least one of the at least two radiating arms has one or more parts acting as stubs.

45. The antenna according to claim 26, wherein said first and second radiating arms are 3D structures.

46. The antenna according to claim 26, wherein the antenna device is a handheld communication device.

47. The antenna according to claim 46, wherein the handheld communication device is a flip-type phone.

48. The antenna according to claim 47, wherein the first and second arms are located near a hinge of the flip-type phone.

49. The antenna according to claim 26, wherein the at least one arm has a substantially linear shape.

50. An antenna device comprising:

at least two radiating arms;

a ground-plane;

a first arm of the at least two radiating arms includes a feeding point at a first end;

a second arm of the at least two radiating arms includes a grounding point at a second end;

wherein the first arm and the second arm are electromagnetically coupled by at least a close proximity region formed by a portion between the first arm and the second arm;

wherein the at least a close proximity region does not intersect an orthogonal projection of the around plane;

wherein the antenna does not include a contact point between the first arm and the second arm; and wherein the antenna is a monopole antenna.

51. An antenna device comprising:

at least two radiating arms;

a ground-plane;

a first arm of the at least two radiating arms includes a feeding port, the feeding port including a feeding point at a first end of the first arm and a contact point on the ground-plane;

a second arm of the at least two radiating arms includes a grounding point at a second end;

wherein the at least two radiating arms are monopoles;

wherein at least one of the at least two radiating arms is provided with an unbalanced feed;

wherein the first and second radiating arms are electromagnetically coupled by at least a close proximity region formed by a portion between the first and second radiating arms;

wherein the at least a close proximity region does not intersect an orthogonal projection of the ground plane; and wherein the antenna does not include a contact point between the first and the second radiating arms.

52. An antenna device comprising:

at least two radiating arms;

a ground plane;

a first arm of the at least two radiating arms includes a feeding point at a first end;

a second arm of the at least two radiating arms includes a grounding point at a second end;

wherein the first and second radiating arms form at least one close proximity region and are 3D structures;

wherein the at least one close proximity region does not intersect an orthgonal projection of the ground plane; and wherein said antenna is a monopole antenna.

* * * * *